US005967455A

United States Patent [19]

Farber

[11] Patent Number: 5,967,455

[45] Date of Patent: Oct. 19, 1999

[54] SINGLE-STEP MOLDED REEL

[75] Inventor: Terry L. Farber, Columbia City, Ind.

[73] Assignee: Mossberg Industries, Inc., Cumberland, R.I.

[21] Appl. No.: 09/127,171

[22] Filed: Jul. 31, 1998

Related U.S. Application Data

[60] Provisional application No. 60/055,085, Aug. 1, 1997.

[51] Int. Cl.[6] ..... B65H 75/08

[52] U.S. Cl. ..... 242/613; 242/118.31; 242/118.32; 242/610.6; 242/614.1

[58] Field of Search ..... 242/610, 610.6, 242/613, 614, 614.1, 118.3, 118.31, 118.32, 118.7

[56] References Cited

U.S. PATENT DOCUMENTS

| | | | |
|---|---|---|---|
| 382,091 | 5/1888 | Kelsea | 242/609.1 |
| 391,456 | 10/1888 | Cross | 242/118.61 |
| 671,446 | 4/1901 | Lorscheider | 242/608.7 |
| 1,270,614 | 6/1918 | Harmon | 242/608 |
| 1,410,014 | 3/1922 | Hurlburt | 242/609 |
| 1,566,788 | 12/1925 | Clark | 242/118.61 |
| 1,811,517 | 6/1931 | Mossberg | 242/608.8 |
| 2,059,709 | 11/1936 | Rueger . | |
| 2,156,363 | 5/1939 | Tucker, Jr. . | |
| 2,193,158 | 3/1940 | Bezanson . | |
| 2,626,764 | 1/1953 | Dunlap . | |
| 2,643,830 | 6/1953 | Paeplow et al. . | |
| 2,887,282 | 5/1959 | Morin | 242/118.7 |
| 2,902,234 | 9/1959 | Morin | 242/118.7 |
| 2,911,163 | 11/1959 | Warrick . | |
| 2,922,596 | 1/1960 | Morin | 242/118.7 |
| 2,990,133 | 6/1961 | Tucker, Jr. | 242/118.7 |
| 3,099,414 | 7/1963 | Kulka | 242/614 |
| 3,284,021 | 11/1966 | Ryll et al. | 242/118.6 |
| 3,289,972 | 12/1966 | Hafner | 242/118.7 |
| 3,323,743 | 6/1967 | Landgraf . | |

(List continued on next page.)

FOREIGN PATENT DOCUMENTS

| | | | |
|---|---|---|---|
| 558182 | 7/1957 | France . | |
| 1 291 747 | 7/1965 | France | 242/613 |

OTHER PUBLICATIONS

Table of Contents and Advertisements of the Directory of Wire Companies of North America, 1991, Edition, advertisement for Carris Reels, Inc. and the Bridge Mfg. Co., Inc. Sonoco Products Co., Carlton Manufacturing Co., Crellin, Inc. and Mossberg Industries, Inc., (6 pages) published by Business Information Services, Inc.

*Primary Examiner*—Donald P. Walsh
*Assistant Examiner*—William A. Rivera
*Attorney, Agent, or Firm*—Madson & Metcalf

[57] ABSTRACT

A reel, alternately called a spool, may be manufactured in a fully assembled, single, homogeneously molded piece. Processes may include injection molding, blow molding, and other suitable molding processes adapted to polymeric resins. The apparatus and method are well adapted to manufacturing processes using olefinic resins, such as polypropylene and polyethylene. The resulting reel or spool may serve as a take-up reel for receiving, storing, transporting, and dispensing stranded materials wound thereon. The barrel may fit within a cylindrical envelope extending between hub portions of flanges disposed at opposite ends. An arbor hole extends along the longitudinal axis of rotation for supporting the reel. Flanges extend radially from the barrel, substantially orthogonally thereto, on a smooth, inside face of each flange. Flanges may be tapered, ribbed, and so forth in order to obtain proper stiffness with minimum weight, while still remaining moldable in a single process not requiring post-molding assembly. Apertures serving as drive holes for a drive pin, start holes for stranded (e.g. wire) material, and tie holes may be provided by pins of sufficiently small dimension to not interfere with hydraulic and cooling channels in the molds. Certain methods may use large core pulls, but certain embodiments may be made from two piece molds having "pull pins" only for the arbor hold and the aforementioned apertures. Tooling slides may be used but are not required.

16 Claims, 12 Drawing Sheets

U.S. PATENT DOCUMENTS

| | | | |
|---|---|---|---|
| 3,447,674 | 6/1969 | Fraser | 242/610.6 |
| 3,552,677 | 1/1971 | Hacker | 242/118.61 |
| 3,591,104 | 7/1971 | Hafner | 242/614.1 |
| 3,726,489 | 4/1973 | Honsa | 242/610.6 |
| 3,757,626 | 9/1973 | Kulp | 83/542 |
| 3,817,475 | 6/1974 | Goldstein . | |
| 3,854,509 | 12/1974 | Bailey . | |
| 3,861,606 | 1/1975 | Loquineau et al. . | |
| 3,907,232 | 9/1975 | Odermatt | 242/118.32 |
| 3,966,139 | 6/1976 | Terpak | 242/118.7 |
| 4,128,215 | 12/1978 | Underwood | 242/118.61 |
| 4,184,640 | 1/1980 | Nelson et al. . | |
| 4,244,535 | 1/1981 | Moodie . | |
| 4,252,587 | 2/1981 | Harden et al. | 156/73.05 |
| 4,345,724 | 8/1982 | Lindell . | |
| 4,512,361 | 4/1985 | Tisbo et al. | 137/355.27 |
| 4,620,676 | 11/1986 | Missalla . | |
| 4,624,421 | 11/1986 | Takeuchi . | |
| 4,726,534 | 2/1988 | Chenoweth . | |
| 4,789,111 | 12/1988 | Thomas et al. | 242/118.3 |
| 4,793,568 | 12/1988 | Romagnoli | 242/118.3 |
| 4,895,316 | 1/1990 | Salloum . | |
| 4,903,913 | 2/1990 | McCaffrey . | |
| 4,976,475 | 12/1990 | Bjorkqvist . | |
| 4,997,142 | 3/1991 | Grant | 242/118.4 |
| 5,137,204 | 8/1992 | Compagnucci | 228/173.4 |
| 5,143,316 | 9/1992 | Goetz et al. | 242/129.5 |
| 5,197,689 | 3/1993 | Barone | 242/118.7 |
| 5,203,516 | 4/1993 | Donaldson . | |
| 5,236,145 | 8/1993 | Floury et al. | 242/116 |
| 5,252,369 | 10/1993 | Akao et al. | 428/34.9 |
| 5,265,821 | 11/1993 | Takatori . | |
| 5,464,171 | 11/1995 | Ripplinger | 242/609.1 |
| 5,605,305 | 2/1997 | Picton | 242/608 |
| 5,660,354 | 8/1997 | Ripplinger | 242/608 |
| 5,820,049 | 10/1998 | Atkinson et al. | 242/118.31 |

SINGLE-STEP MOLDED REEL

RELATED APPLICATIONS

This application is a continuation of a co-pending application Ser. No. 60/055,085 filed Aug. 1, 1997 and directed to a ONE-PIECE UTILITY REEL.

THE FIELD OF THE INVENTION

The invention relates generally to utility reels and spools used, for example, for containing and dispensing wire or other stranded materials, and more particularly, to reels and spools of molded polymer construction.

THE BACKGROUND ART

Stranded materials, upon manufacture, are typically taken up directly onto a reel or spool. Utility reels and spools are well known in the art and are widely used for containing and dispensing wire, tubing, fabric and other stranded products which lend themselves to being wound helically and/or over themselves. The reel or spool is generally comprised of a cylindrical tube or barrel having at its ends two flanges, each having an inside and an outside face, the axis of the barrel extending normally from the faces defined by the inside surface of each flange.

A take-up reel or spool receives a strand directly from the last step in the manufacturing process. Thereafter, the filled reel is effective for storage and handling purposes. Upon sale or distribution, the spool is often placed on an arbor, either alone or with other spools, for convenient dispensing of the linear or stranded material. Linear or stranded materials include electrical wire whether in single or multiple strands and cable (comprised of multiple wires), rope, wire rope, hose, tubing, chain and plastic and rubber profile material (generally any polymeric or elastomeric, extruded flexible material). In general, a host of elongate materials as diverse as pharmaceutical unit dose packages, fiberoptic line and log chains are stored on reels. Likewise, ribbon, thread and other stranded materials are wrapped on spools.

The requirement for a reel or spool in the manufacture and handling of wire is substantially different than spools in the textile industry. For example, the weight of wire is several times the weight of thread or rope. The bulk of wire, which translates to the inverse of density, is substantially lower for wire than for hose, tubing or even chain.

Meanwhile, many spools or reels are typically launched on a one way trip. The collection and recycling of spools is hardly worth the effort in many instances, considering that their materials are not easily recyclable. In the art, a typical spool has a tubular or "barrel" portion extending between two flange portions positioned at either end.

Spools may be assembled, adding costly operations in manufacturing. Moreover, spools may break at the corner where the tube portion meets the flange portion or may fracture at an engagement portion along the tube portion. Three-piece spools typically break near the corner between the flange and the tube portion or where a joint bonds the tube portion to the flange portion.

What is needed is plastic spools that may be easily made, using automated processes minimizing human intervention, that are strong enough to tolerate the abuse of use when fully wrapped with wire or cable, and which may be easily recycled, such as by re-grinding for shipping.

Large spools are typically called reels in the wire industry. Heavy-duty reels of 12 inches in diameter and greater (6 feet and 8 feet are common) are often made of wood or metal.

Plastic spools of 12-inch diameter and greater are rare and tend to be very complex. The rationale is simple. Inexpensive plastics are not sufficiently strong to tolerate even ordinary use with such a large mass of wire or cable wrapped around the spool.

Moreover, large flanges for reels are very difficult to manufacture. Likewise, the additional manufacturing cost of large spools is problematic. Designs do not always scale up. Assembly adds to cost, but costs of destroying conventional, multi-material (e.g wood/steel, plastic/steel/paperboard, or sheet metal) reels for sorting and re-grinding materials can be exorbitant.

A large reel or spool is usually manufactured of wood. Nevertheless, a plastic spool in 12-inch diameter may also be manufactured with a pair of plastic flanges holding a layered cardboard (paperboard) tube retained therebetween. The flanges are typically bolted together axially to hold the tube within or without a circumferential detent as with wooden reels.

Such reels have an additional difficulty during use. The flanges do not stay secured. One difficulty with the structural integrity of such a "three-piece," bolted, reel design is that the tube or barrel is not actually fastened to the flange. The flange and tube are often precarious assemblies held together by three or more axial bolts compressing the flanges together. The tube is prone to slip with respect to the flanges, breaking, tilting or otherwise losing its integrity under excessive loads. Such loads result from the impact of dropping onto a floor from a bench height or less (alternatively, a standard drop test). For the largest reels, rolling over or into obstacles or from decks during handling is likely a cause of reel or cable damage.

In the vernacular of the wire manufacturing and supply industry, "spools" have flange diameters up to 10 inches; "reels" have flange diameters greater than 10 inches. Hereinafter, however, the term "reel" shall be understood to apply to either a spool or a reel.

Generally, each flange has a round, central, arbor hole extending into the tube or barrel. An arbor inserted through the central arbor hole in one flange, through the hollow barrel and through the central arbor hole in the other flange provides an axle on which the reel may rotate. A drive hole (dog aperture) is also generally provided in the outside surface of one or both flanges a short distance from the arbor hole to accommodate an externally engaging dog or drive pin (dog, pawl) which orbits the arbor axis and causes the reel to rotate, winding the product onto the barrel.

Instead of a drive hole separate from the arbor hole, a spool may have a non-circular, mating shape for cooperatively engaging a rotating arbor having a corresponding cross section. The product to be stored on the reel is usually attached to the reel and is drawn onto the barrel in a winding fashion as the reel is rotated.

In the case of wire products, at least one of the flanges usually has a pair of through holes for receiving the wire. The first of the pair is a start hole and is located outwardly adjacent the outer surface of the barrel. The second of the pair is a finish hole located near the flange periphery. The leading end of a wire is fed through the start hole from inside of the flange and is knotted, bent or otherwise engages the flange such that the wire will be tensioned by rotation of the reel about the arbor axis. The wire is then cut and the trailing end of the reeled wire is fed through the finish hole and knotted or bent such as to prevent the wire from unraveling from the reel.

Previous utility reels have been assembled from sheet metal, wood, paperboard, or plastic components. Assembly of sheet metal reels may require inserting tabs extending axially from the tube through receiving slots in the flanges and bending or staking the tabs to retain the flanges to the barrel.

Plastic polymeric reels, component barrels, and flanges may be made of ABS, polystyrene, and other materials bonded, welded, or fastened together. Polymers, metal, wood, and other materials are subject to a significant risk of breakage in the field. In very cold environments, plastics become brittle. Because they do not become unacceptably brittle under cold conditions, polyolefin materials such as polyethylene or poylpropylene materials have been used. These materials, however, are chemically inert and are not bonded or reliably welded. Therefore, assembly of polyolefin reel components usually requires interlocking tabs and slots. Regardless of the type of plastic used, manufacturing a plastic reel thus involves two or more distinct steps at workstations remote in time and space. Molding the components occurs at a molding machine. Assembly requires another operation elsewhere.

As a means of storing and dispensing wound, stranded products, a reel itself provides no value to an end user once emptied of product. A great need exists to reduce the cost of providing such products without reducing quality. An economical, durable reel to meet the requirements of product manufacturers and end user is needed.

SUMMARY OF THE INVENTION

An apparatus and method in accordance with the invention may solve a multiplicity of problems, eliminating several limitations existing in the prior art of spools and reels. For example, lacking the multi-piece structure, no assembly occurs after the molding process. Molding may include various (e.g. styrenic, olefinic) plastics not suitable for bonding in other designs using one or more materials for construction. Spools may be manufactured in styrene-based plastics, but the disclosed embodiments are particularly well adapted to manufacture using molded polyethylene, polypropylene, or similar olefinic plastics.

In one embodiment, in accordance with the present invention, a one-piece, non-assembled, molded reel is suitable for use in storing and dispensing wound, stranded products such as wire, tubing, fabric, etc. The cylindrical tube or barrel of the inventive reel has a longitudinal axis of rotation and may be formed of tooling slides that move in opposing directions perpendicular to that axis. The barrel is comprised of walls and ribs formed by the slides to provide stiffness, strength and a circular cross section about the envelope of the barrel. The reel may be made from a material such as polyolefin, including polyethylene or polypropylene, which is tough rather than brittle in low temperature environments and is thus less prone to fracture. The manufacture of a reel need not require secondary assembly operations or appreciably different material quantities or types and thus provides a lower variable cost. Further, all necessary and expected features of such utility reels, such as arbor holes, drive holes and/or start and finish holes, may be provided by the inventive reel. The present invention is adaptable to spools, having flange diameters of up to 10 inches, or reels, having flange diameters greater than 10 inches. Thus, the present invention provides a utility reel which eliminates the secondary assembly operation, is therefore cheaper, and may utilize materials less susceptible to fracture.

A mold having a single contiguous parting surface may form a spool or reel in accordance with the invention. Alternatively, mold slides may be used to provide "core pulls" for indentations. However, pins, of the same order of magnitude as ejector pins may be used to form arbor holes, drive holes for the drive pin (dog) about an arbor, and for start and end holes for securing stranded materials to the spool. Meanwhile, all the performance characteristics required may be provided without post-molding assembly.

BRIEF DESCRIPTION OF THE DRAWINGS

The above-mentioned and other features and objects of this invention, and the manner of attaining them, will become more fully apparent and the invention itself will be better understood by reference to the following description of the invention taken in conjunction with the accompanying drawings, wherein.

DETAILED DESCRIPTION OF THE INVENTION

Figure 1:
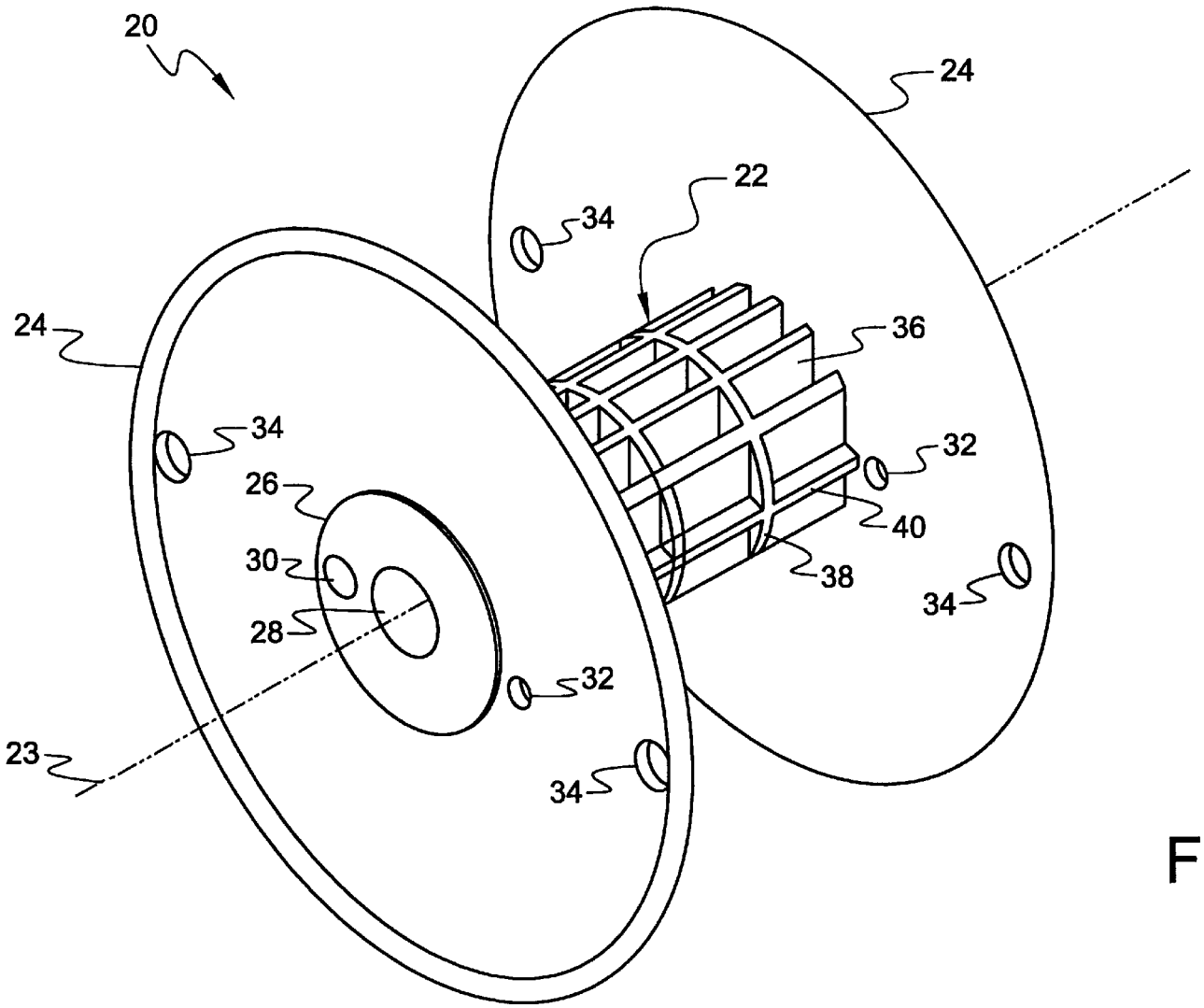
FIG. 1 is an isometric view of a reel according to the present invention.

Referring to the Figures and particularly to FIG. 1, a reel 20 is of injection molded, one (1)-piece construction and is comprised of a barrel 22, hub portions 26 and flanges 24. The barrel 22 is somewhat cylindrical in overall configuration, having a longitudinal axis of rotation 23, and ends in the hub portions 26. The hub portions 26 substantially lie in parallel planes normal to a longitudinal axis 23 and have a diameter substantially defined by the outside diameter of the cylindrical barrel 22. The flanges 24 are somewhat disk shaped and extend radially from the hub portions 26 in planes normal to the longitudinal axis 23. The barrel 22 and the flanges 24 are thus integrated through the hub portion 26 into a single injection molded plastic piece made from a material such as polyethylene or polypropylene, which may include a filler material such as talc. Such polyolefin materials are flexible and not prone to breakage, even in low temperature environments.

Extending through the hub portion 26 and along the axis of rotation through the barrel 22 is an arbor hole 28 defined by the inner surface of a somewhat cylindrical wall 27. The hole 28 is formed about a sliding a core pin (not shown) in the injection mold tooling. The arbor hole 28 rotatably receives an externally inserted arbor upon which the reel 20 rotates and may be stored. A drive hole 30, defined by the inner surface of a somewhat cylindrical wall 31 (FIG. 8), has an axis parallel to the longitudinal axis 23 and is offset from the arbor hole 28, extending from the outside surface of the hub portion 26 into the barrel 22 below the outside surface thereof. The drive hole 30 rotatably receives an externally inserted drive pin (not shown) which revolves around the axis of the arbor hole 28 causing the reel 20 to rotate. Such rotation of the reel 20 winds the material onto the barrel 22. The arbor hole 28 may have a non-circular cross section adapted to slide over an arbor of corresponding cross sectional shape and, if such an arbor is adapted to torsionally rotate, the drive hole 30 may be eliminated.

In some embodiments of the present invention reel, at least one (1) start hole 32 is provided which extends through the flange 24 and is proximal the outside surface of the barrel 22. The start hole 32 has an axis parallel the longitudinal axis 23 and may be used, for example, to receive the lead end of a wire to be wound upon the reel 20. A sufficient amount of wire is fed into the start hole 32 to provide that as the reel 20 rotates the outside surface of the wire bears against the edges of the start hole 32, placing the wire in tension and allowing it to be pulled onto the barrel 22. Therefore, the start hole 32 is appropriately sized to provide such bearing engagement between the wire and the edge of the hole. Alternatively, the leading end of the wire may be bent or knotted after insertion through the start hole 32 to provide such bearing engagement between the wire and the flange 24. These embodiments may include at least one (1) finish hole 34 near the outer periphery of the flange 24 to receive the trailing cut end of the wire wound onto the reel 20. The trailing end of the wire is inserted through the finish hole 34 from between the flanges and is bent or knotted to prevent the wire from unraveling. The finish hole 34 is generally at least as large in diameter as the start hole 32 and also has its axis parallel to that of the longitudinal axis 23.

The barrel 22 is formed by injection mold tooling slides 42, 44 (FIG. 7) which move in opposing directions perpendicular to the longitudinal axis 23 and comprises a plurality of walls and ribs which define cavities which extend in a parallel fashion into the barrel's outside surface. The walls and ribs provide stiffness, strength, and a circular cross section to the barrel.

Figure 2:
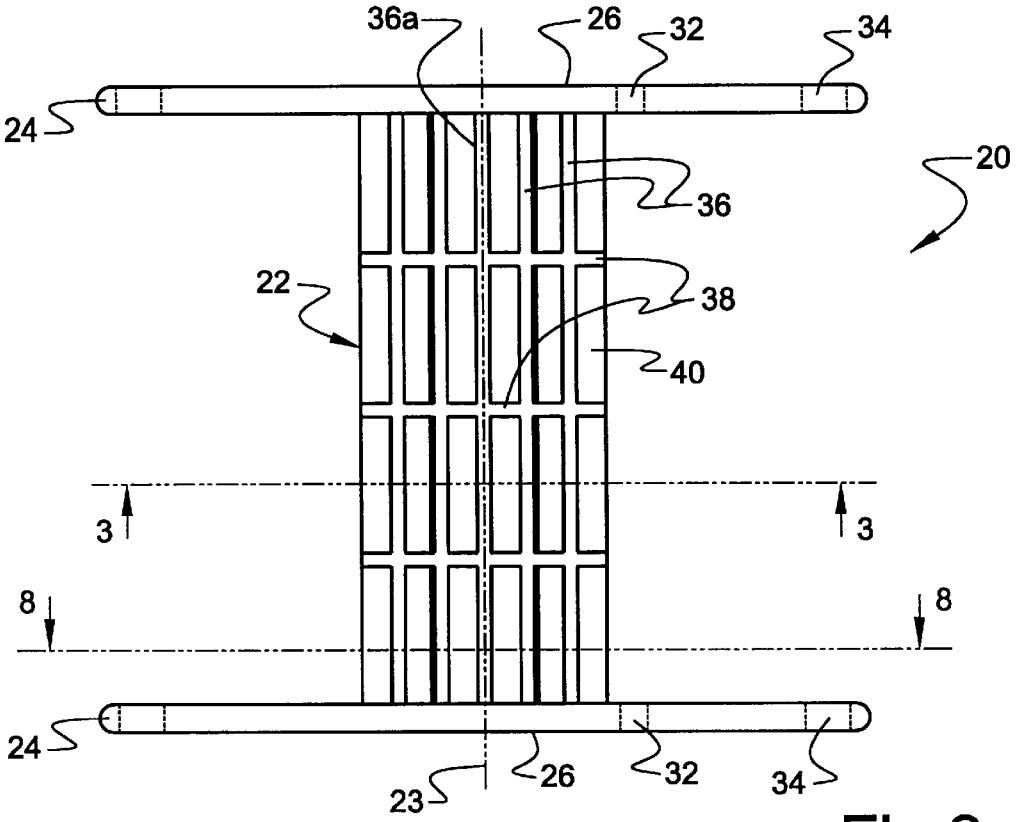
FIG. 2 is a top view of the reel of FIG. 1.
Figure 3:
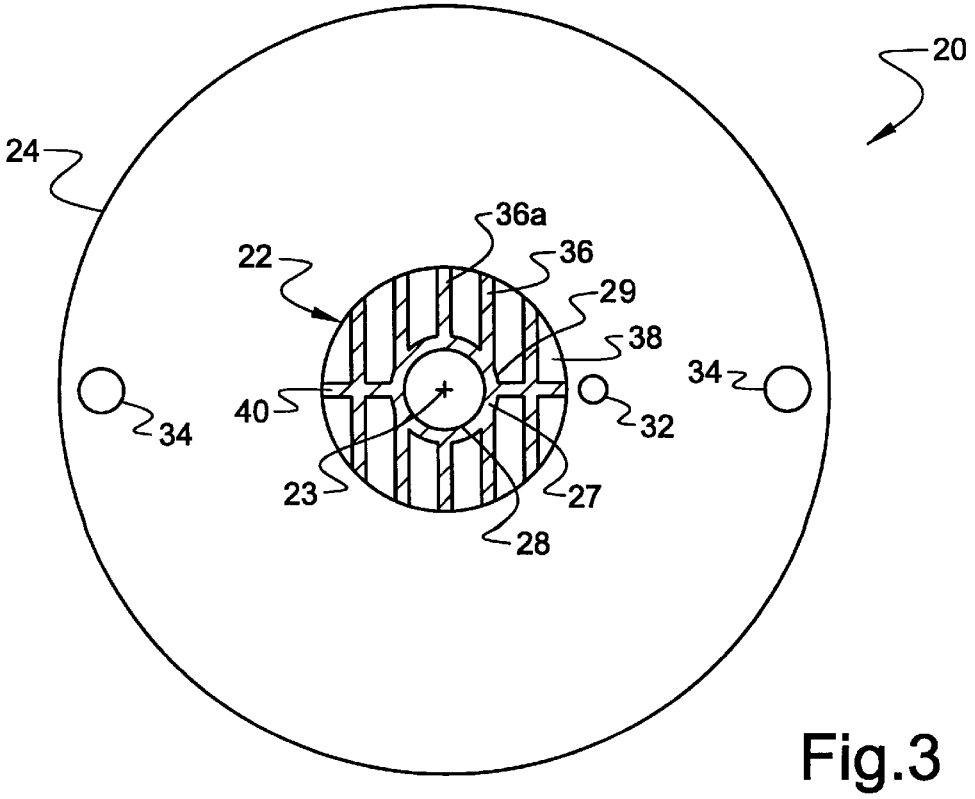
FIG. 3 is a sectional side view along line 3—3 of FIG. 2.
Figure 4:
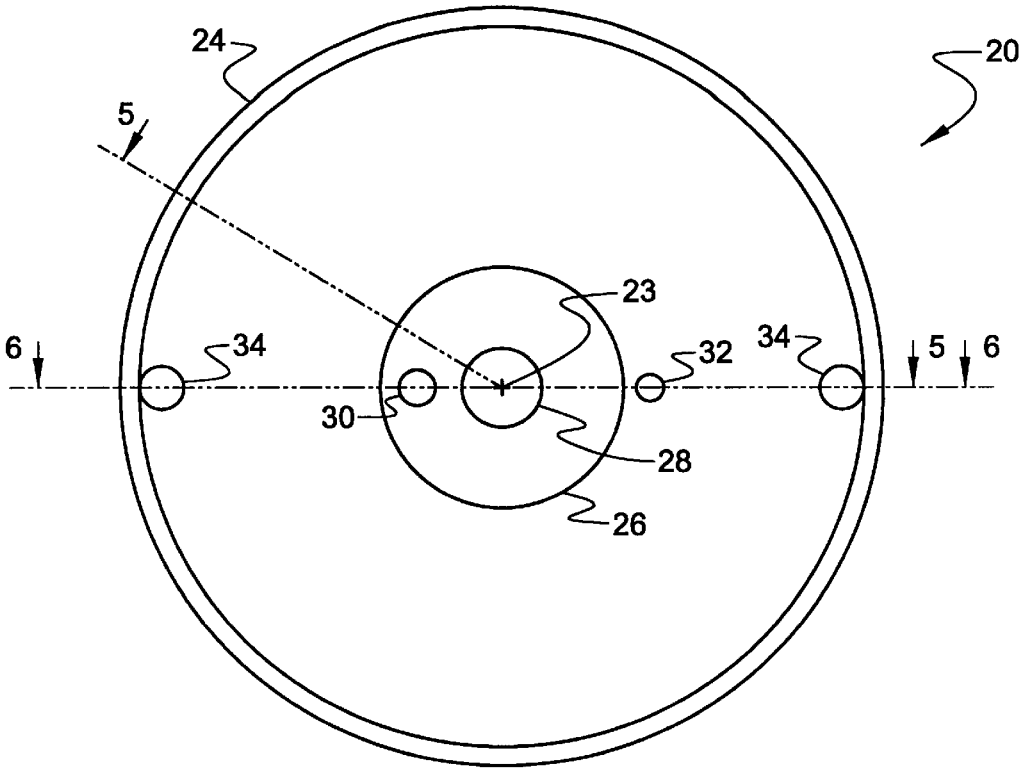
FIG. 4 is an end view of the reel of FIG. 1.
Figure 5:
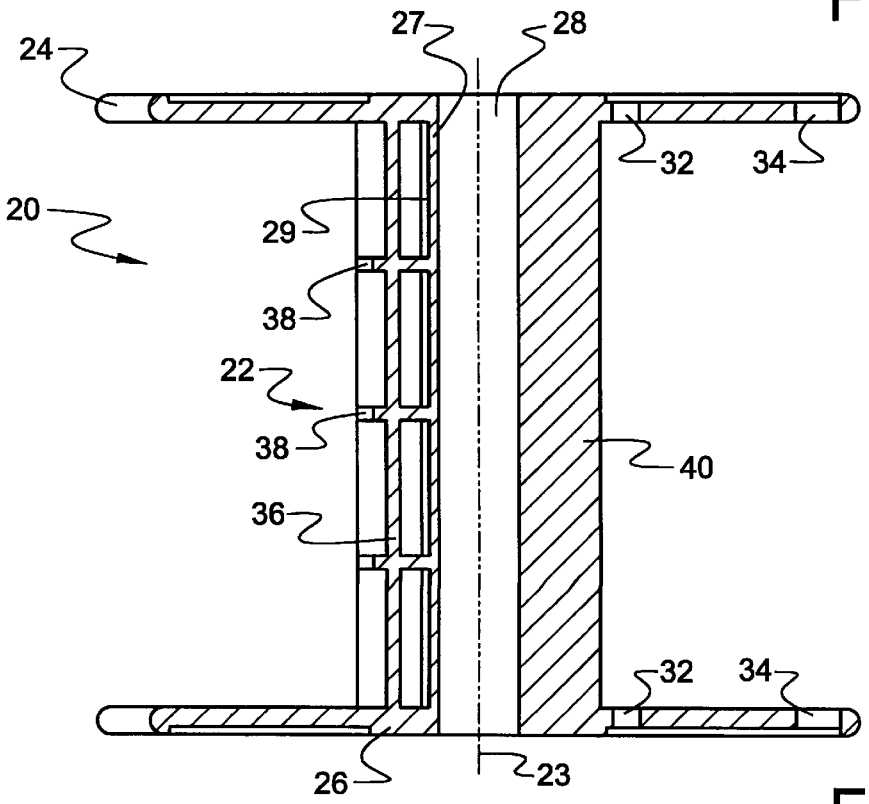
FIG. 5 is a sectional top view along line 5—5 of FIG. 4.
Figure 6:
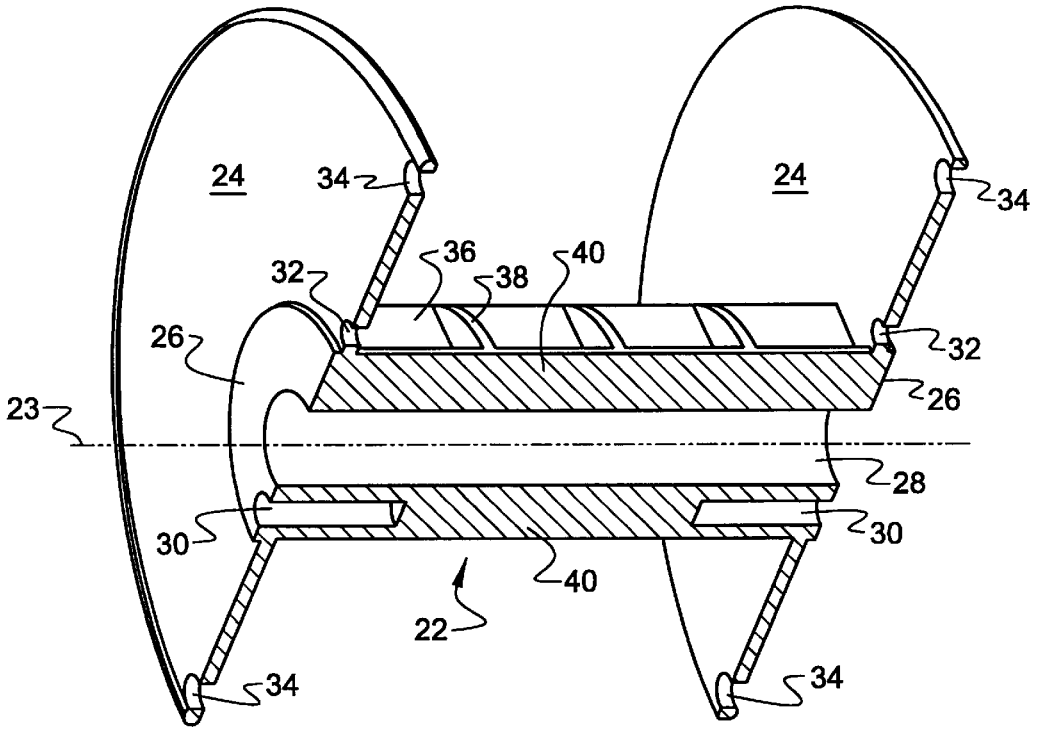
FIG. 6 is an isometric sectional view along line 6—6 of FIG. 4.
Figure 7:
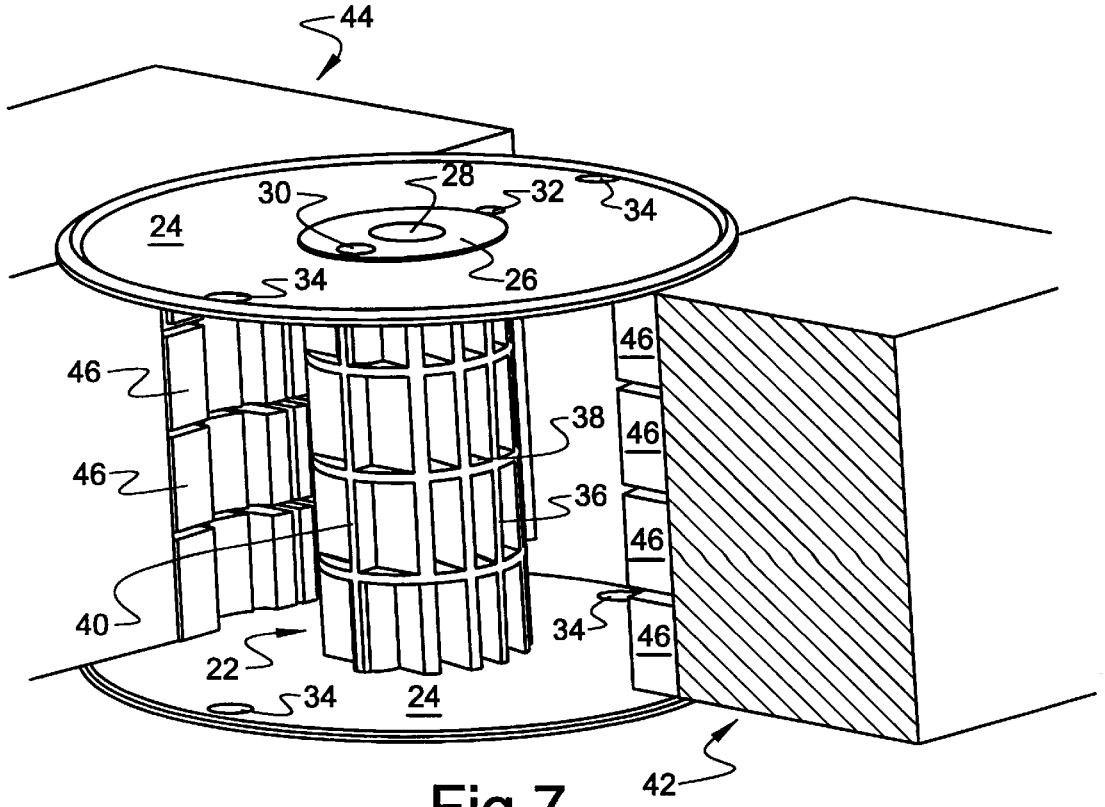
FIG. 7 is a partial sectional view of the reel of the present invention and associated slides of its injections mold tooling.
Figure 8:
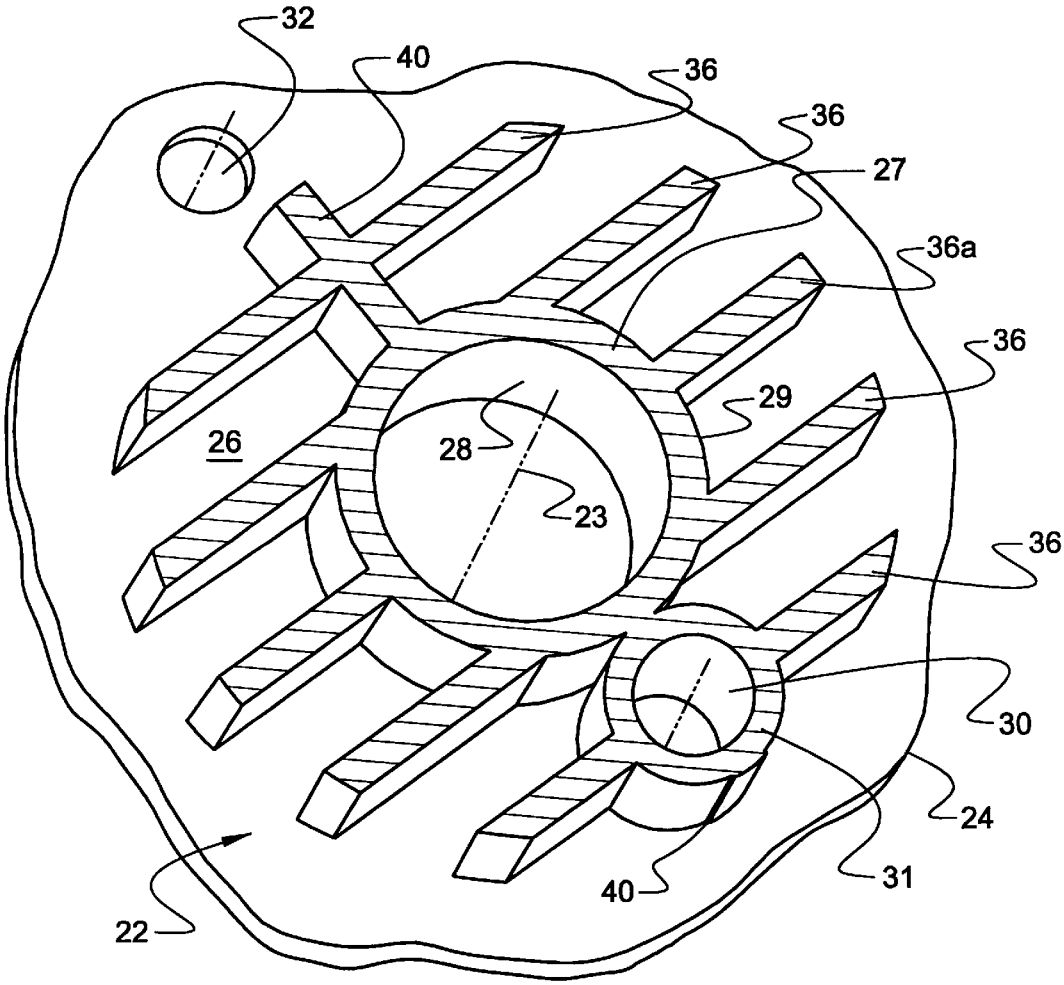
FIG. 8 is a fragmentary sectional view of line 8—8 of FIG. 2.

Referring to FIGS. 2 and 3, the barrel 22 is comprised of a mating wall 40 which lies in a plane containing the longitudinal axis 23, extends longitudinally between the hub portions 26 and has an overall width defining the outside diameter of the barrel. As best seen in FIG. 3, the wall 40 is interrupted at its center as it intersects an outside surface 29 of the somewhat cylindrical arbor hole wall 27 and has thickness equivalent to the distance between the opposing portions of injection mold tooling slides 42 and 44 (FIG. 7) which form the barrel 22. Referring to FIG. 8, the wall 40 is also interrupted near one end thereof as it intersects the drive hole wall 31. Referring again to FIGS. 2 and 3, the barrel 22 is further comprised of a plurality of parallel walls 36 lying in planes perpendicular to the wall 40 and extending longitudinally between the hub portions 26. The walls 36 extend in the direction that the slides 42 and 44 (FIG. 7) move or "pull." A wall 36*a* is the widest of the walls 36 and lies in a plane containing longitudinal axis 23, having overall width equivalent to the outside diameter of the barrel. As best seen in FIGS. 3 and 8, the widest wall 36*a* and the walls 36 adjacent thereto are interrupted at their centers as they intersect the outside surface 29 of the somewhat cylindrical arbor hole wall 27. A plurality of ribs 38 (FIGS. 2, 5) are equally spaced along the traverse of the barrel 22 in parallel planes normal to longitudinal axis 23. As seen in FIG. 3, the ribs 38 are substantially circular and have an outside diameter conforming to the overall widths of the walls 36*a* and 40. Each of the ribs 38 intersects the somewhat cylindrical arbor hole wall 27, the outer surface 29 of the arbor hole wall 27 integrally mated to the inside diameter of each rib 38. The remaining parallel walls 36 are somewhat equally spaced from the wall 36*a* and the overall width of each wall 36 is limited by the outside periphery of the ribs 38, to which the walls 36 extend. Hence, the walls 36 become successively shorter in length with the distance along the wall 40 from the wall 36*a*. The thickness of the walls 36 and the ribs 38 is defined by the distance between the complementary elements 46 in injection mold tooling slides 42, 44 (FIG. 7). It should be noted that the surfaces of the walls 36, the ribs 38, the wall 40, the arbor hole 28 and the drive holes 30 and the inside surfaces of the flanges 24 are necessarily adapted to include a draft angle to accommodate the release of the reel 20 from the tooling as the slides 42, 44 are pulled apart after material has been injected into the mold.

The outside surface of each flange 24 and/or hub portion 26 is formed by injection mold tooling having a cavity corresponding thereto (not shown) which pull in directions perpendicular to those in which the slides 42 and 44 pull. Tooling for the holes 28, 30, 32 and/or 34 may be incorporated into the tool which forms the outside surface of the hub portion 26 and/or the flange 24 or may comprise individual slides accommodated by such tooling.

Injection molding process steps by which the reel 20 is produced may comprise moving the slides 42 and 44 together until they abut at points outside the cavity which forms the barrel 22 and surround the core pin (not shown) which forms the arbor hole 28 at the inside surface of the arbor hole wall 27. Slides (not shown) containing the cavities which form the outside surface of each flange 24 and/or the hub portion 26, which may also include core pins which form the holes 28, 30, 32 and/or 34, are placed at the longitudinal ends of the cavity forming the barrel 22 and into an abutting relationship with the slides 42, 44. Air is evacuated from the interconnected cavities and heated polyolefin material is injected under pressure therein. Upon cooling the material to a somewhat solid state within the mold, the slides (not shown) which form each hub portion 26 and/or flange 24 are retracted axially along the longitudinal axis 23, and the slides 42 and 44 are moved in opposite directions perpendicular to the axis 23 to release the newly formed reel 20. Alternatively, the sequence of slide movement may vary from that described above and the core pins which form the holes 28, 30, 32, and 34 may themselves slide relative to the slides which form each flange 24 and/or hub portion 26.

In the illustrated embodiment discussed above, two (2) flanges are shown, although this should not be construed as limiting the scope of the invention. It is contemplated that the present invention encompasses reels comprising hub portions with and without radially and axially extending flanges, which may be adapted to storing and dispensing stranded materials such as, for example, fabric, wire, thread, for example, and a reel having more than two flanges used, for example, to store and dispense wire having different gage sizes or insulation jacket colors.

Figure 9:
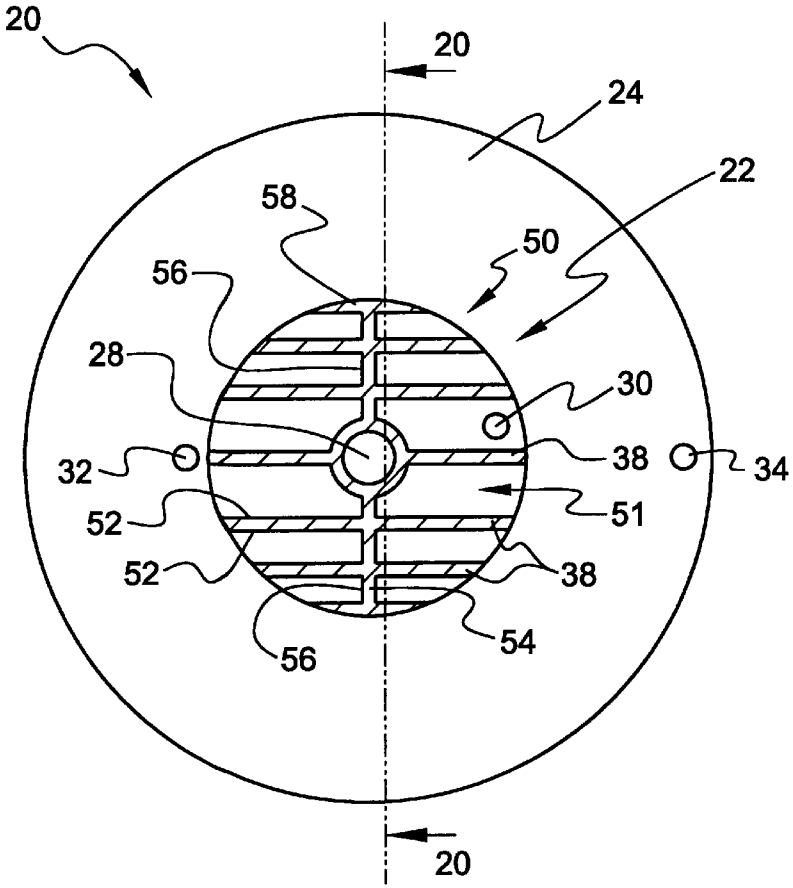
FIG. 9 is an end elevation view of a sectioned spool in accordance with the invention.

Referring to FIG. 9, a spool 20 may be molded from a mold having a single parting surface. In general, core polls are to be avoided. Core polls involve arrangements such as the mold slides available for alternative embodiments of spools in accordance with the invention. Nevertheless, so long as two portions of a mold form the entire mold, separation must occur in a single direction. Cores oriented to withdraw from a molded workpiece in a direction other than the direction of travel of the two-piece mold are usually avoided. As a practical matter, ejection pins travel in the same direction as the mold. Nevertheless, where hydraulic actuation is not subjected to the mold pressures, the mold support available from a press is not required.

In one embodiment of an apparatus and method in accordance with the invention, small cores may be provided of the same order of magnitude in size as ejection pins. Using hydraulic actuation, with proper sealing, core pins may be hydraulically moved from one side of a mold to penetrate through the mold cavity to terminate in the opposite portion of the mold. Accordingly, the pin need not be subjected to an unbalanced load from the pressure forces within a mold.

Similarly, small core rods may be hydraulically actuated to move from one portion of one piece of a mold (e.g. one half of the two separating halves) through an included cavity, to penetrate back into the same mold half. Again, the core need not sustain any unbalanced pressures from the injection process. Since drive holes, for receiving a dog, pawl, or pin, to rotate a spool 20 about an arbor hole 28 are of comparatively small size, pulling such pins is not a major undertaking. Moreover, the dimensions and displacements are sufficiently small that pins to form the drive hole 30, the start hole 32, and the tie hole 34 or end hole 34 need be no larger than conventional ejection pins. Although the arbor hole 28 is somewhat larger, symmetry and a central location render it a tractable extraction. Nevertheless, unlike the drive hole 30, the start hole 32, and end hole 34, the arbor hole 28 is centrally located along the plane.

A spool 20 may be formed to present a wall 48 of a flange 24 adapted to restrain a stranded material, such as wire or cable, around an envelope defined by a barrel 22 or tube 22. In an apparatus and method in accordance with the invention the barrel 22 need not be an actual tube.

In a barrel 22, ribs 50 may be formed to define cavities 51 therebetween. The faces 52 corresponding to ribs 50 may have a common draft angle for ease of removal of a molded piece 20 after fabrication.

In one embodiment, cross-ribs 54 may extend between ribs 50, intersecting at any desired and appropriate angle. The cross-ribs 54 extending between faces 52 of adjacent ribs 50, may be molded along a central axis extending radially away from the spool 20. In one embodiment, a crown 58 may form an outermost circumference at an extremity of the cross-ribs 54. Thus, the crown 58 may improve the shape of the barrel 22 by minimizing the difference between a tangent and a chord extending between adjacent ribs 52. The face 56 of each cross-rib 54 defines a closed cavity 51 bordered by adjacent ribs 50. Depending upon the arrangement of section-modulus-enhancing treatments of the flange 24, a spool 20 formed in accordance with the embodiment of FIG. 9, may be formed in a two-piece mold opening along a single axis. The only caveat is the formation of the holes 30, 32, 34. As a practical matter, the arbor hole 28 may actually be formed without a core required. For example, since the arbor hole 28 extends along the entire length of the barrel 20, alternating portions of the mold may extend through the arbor hole 28. Accordingly, the arbor hole 28 may actually be defined by a series of opposing and axially offset, semi-circular walls 70.

Figure 10:
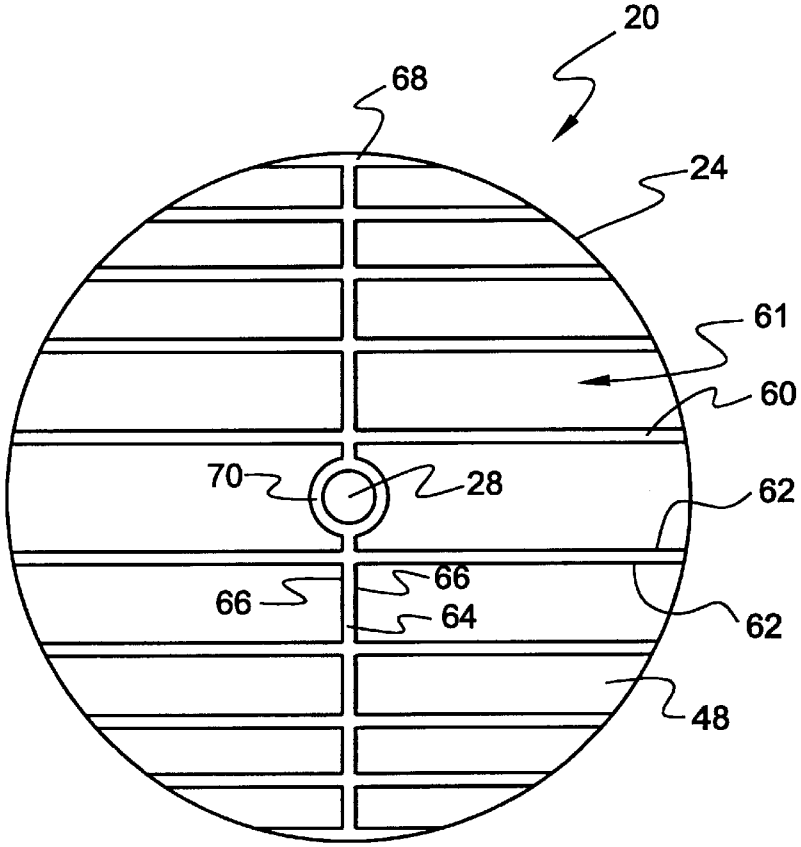
FIG. 10 is an end elevation view of one embodiment of a flange in accordance with the invention, and may also represent one alternative embodiment of a barrel of a reel or spool in accordance with the invention.
Figure 19:
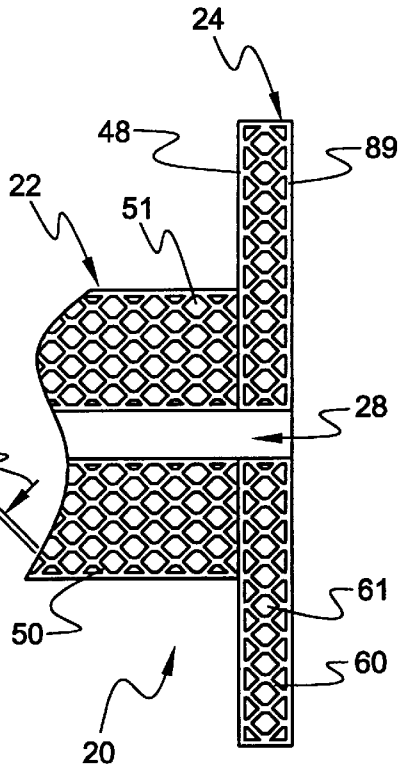
FIG. 19 is a side, elevation, cross-sectional view of an alternative embodiment of a reel made in accordance with the invention.
Figure 18:
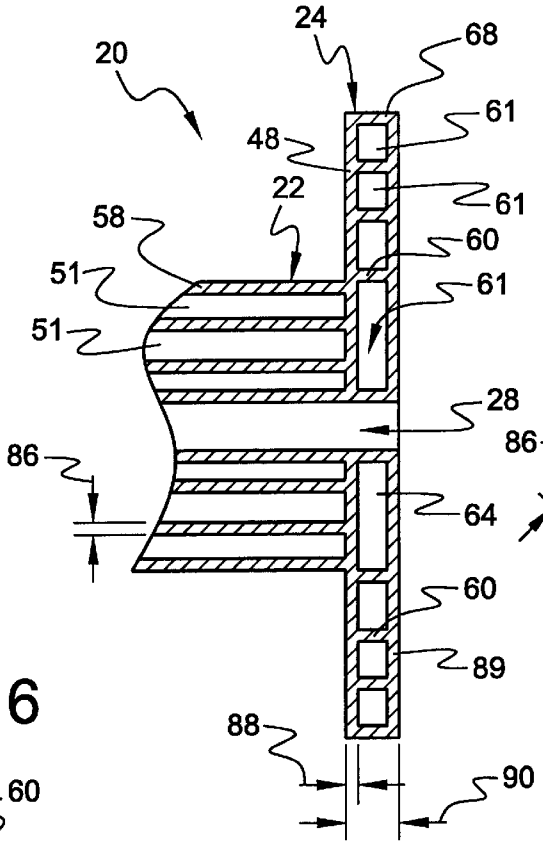
FIG. 18 is a side, elevation, cross-sectional view of the reel of FIG. 9.

Referring to FIG. 10, and generally to FIGS. 1–29, a flange 24 of a spool 20 may have ribs 60 disposed in a manner similar to that of the ribs 50 of a barrel 22. Cavities 61 may be formed by adjacent ribs 60. The faces 62 of adjacent ribs 60 may intersect a cross-rib 64. The connecting faces 62, 66 of the ribs 60 and cross-ribs 64, respectively, thus define a cavity 61. The cavity 61 may be open in an axial direction, as illustrated in FIG. 10, or may be closed, as illustrated in FIGS. 18–19. A crown 68 may provide additional stiffness, smooth transition, and the like, in addition to strength. The embodiment of FIG. 10 contains no rim 92 (See FIG. 20), in order to avoid a core pull. All embodiments of the spools 20 of FIGS. 9–22 may include service holes 30, 32, 34. The cavities 61 may be equal in radial dimensions along the cross-ribs 64, but need not be. The wall 70 forms a bushing 70 or journal 70. Nevertheless, the wall 48 may be all that is required for a bearing surface about the arbor hole 28.

Figure 11:
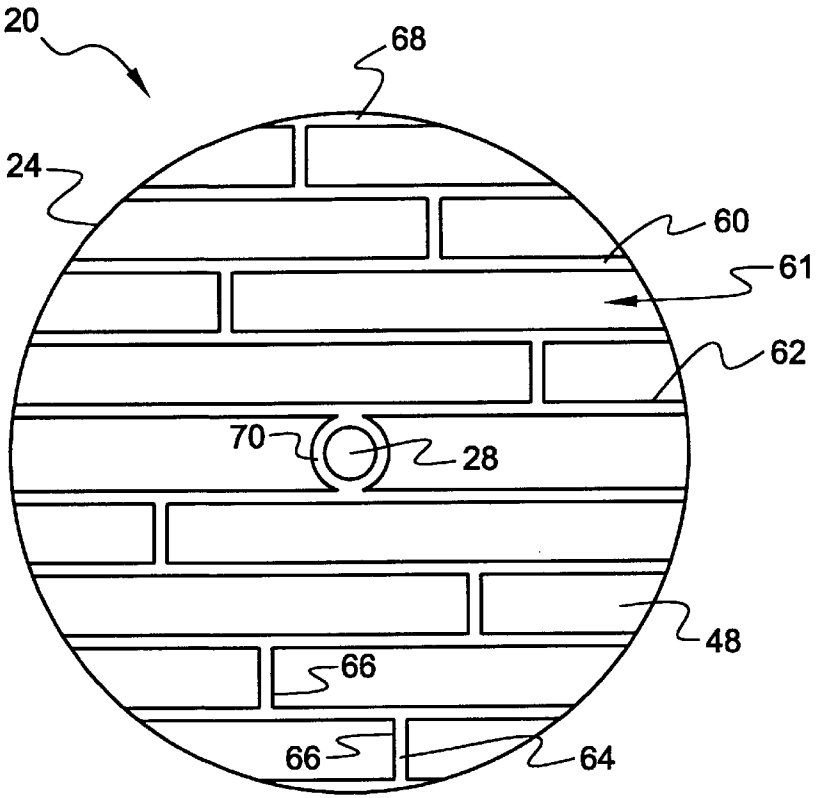
FIG. 11 is an end elevation view of a flange in accordance with the invention, and may be interpreted also as one embodiment of a barrel thereof.

Referring to FIG. 11, and generally to FIGS. 1–29, a spool 20 may contain one or more barrels 22 or flanges 24, having offset cross-ribs 64. Note that the cross-ribs 64 may be representative of a cross-rib 54 insofar as FIGS. 10–13 are concerned. Thus, to the extent applicable, facts stated for a flange 24 may be applied to a barrel 22. A flange 24 and barrel 22 need not use the same design shape for their respective cavities 61, 51 and ribs 60, 50.

In general, an arbor hole 28 may be suitably sized in accordance with the respective size and shape of a corresponding barrel 22 and flange 24. In one presently preferred embodiment, a journal 70 may form a wall 70 about an arbor hole 28. Nevertheless, a thickness of a wall 48 may suffice as a bearing surface for the arbor hole 28.

In one presently preferred embodiment, cross-ribs 66 may be offset from one another. Placing all cross-ribs 66 in a line through a center of the spool 20 is convenient. Nevertheless, additional stiffness and flexibility may be distributed over the entire flange 24 (or barrel 22) by a suitable distribution of cross-ribs 66 in the cavities 61. Thus, the sizes of the adjacent cavities 61 may not be identical. Flexibility may be available by separation of cross-ribs 66. Alternatively, increased stiffness may be available by maintaining the cross-ribs 66 in relatively close proximity to a shared center line. However, in one embodiment, the aspect ratio of width of each cavity 61 to the offset distance between adjacent cross-ribs 66 sharing a single intermediate rib 60 may be close to unity. Thus, a comparatively stiff beam-like region may be formed to extend orthogonally to the ribs 60. By maintaining an aspect ratio not far from unity, the lattice work of ribs 60 and cross-ribs 66 extending away from the arbor hole 28 may provide substantial strength with only slightly more complex interweaving of mold cores projecting from each "half" of the subject mold.

Figure 12:
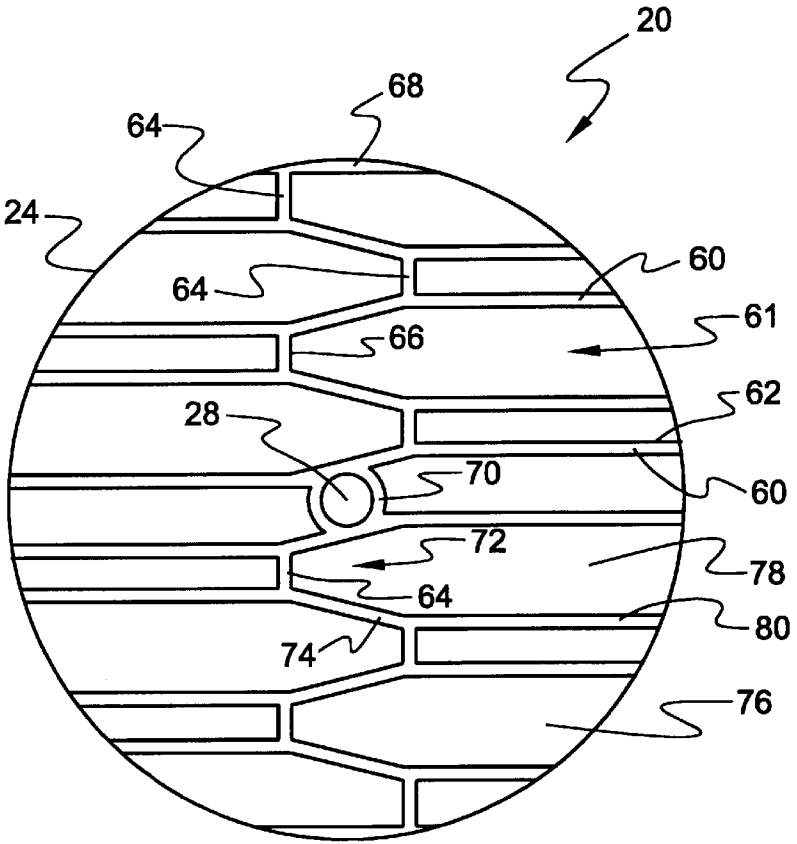
FIG. 12 is an end elevation view of a flange in accordance with the invention having a trapezoidal cavity between ribs in accordance with one embodiment of the invention, and may also be interpreted as a cross-sectional view of a barrel of a spool in accordance with the invention having a different flange design.

Referring to FIG. 12, for example, the spool 20 may include cavities 61 bounded by ribs 60 having a certain trapezoidal cavity 72. One may see that draft angles notwithstanding, tapering adjacent cavities 61, by changing the orientation of the corresponding ribs 60 or walls 60, must typically continue across the entire dimension of a molded piece, or must provide for extraction of a mold. Accordingly, insofar as the shape of a cavity 61 is substantially rectangular, draft angles in a mold may vary the comparative dimensions of the ribs 60, in order to accommodate extraction of a part from a mold cavity.

On the other hand, interleaving offset cores in order to form the geometry of FIG. 11, may be somewhat tricky for an operator of modest experience. However, cores in a mold designed to form the trapezoidal cavities 72, may be readily interleaved since the cross-ribs 64 are comparatively narrow. Thus, a core effective to form the trapezoidal cavities 72 will readily self-center in a corresponding location within an opposing and corresponding cavity of a mating mold half.

Accordingly, the trapezoidal ribs 74 may angle away from the ribs 60, such that the overall cavity 61 comprises both the trapezoidal cavity 72 and a cavity 76 characterized as straight (within the limits of molding practice, draft angle, etc.).

Cavities 61 may typically include linear or rectangular cavities 76 along with hybrid cavities 78. The hybrid cavities 78 will contain a rectangular portion terminating in a trapezoidal portion 72. Clearly, alignment is a much simpler proposition for cores required to form the cavities 76, 78 than cores for accommodating the cavities 61 of FIG. 11. A shared wall 80 of a flange 24 or barrel 22 will necessarily extend to the beginning of a paper cavity 72 and the cross-rib 66 at which the hybrid cavity 78 breaks or bends to form the trapezoidal rib 74. Draft angles for the shared wall 80 may be larger, or skewed (see FIG. 29) in order to provide ready extraction of a molded piece (spool 20) after molding.

Figure 13:
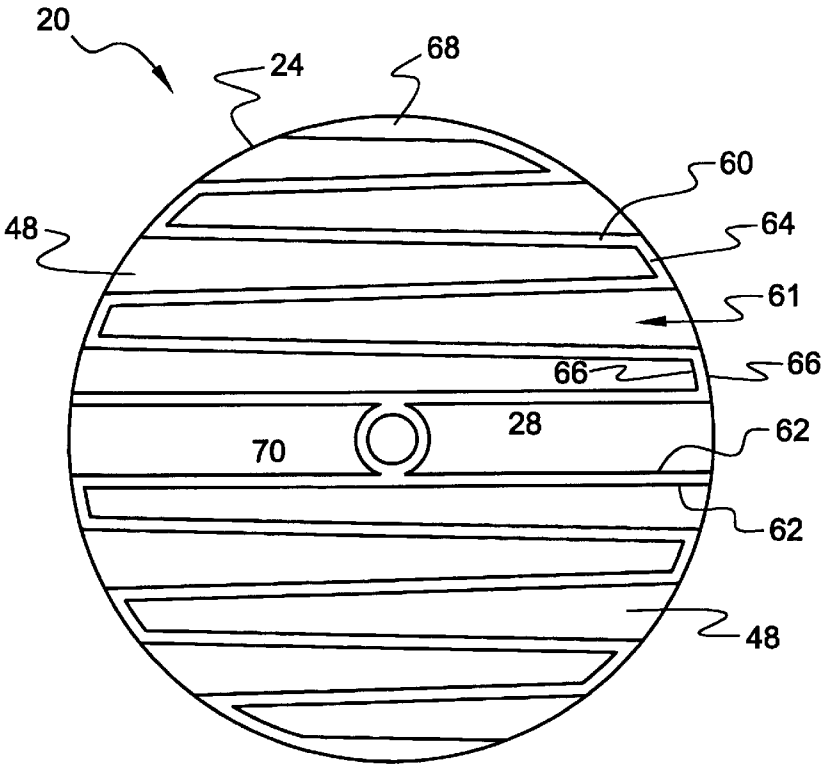
FIG. 13 is an end elevation view of a flange having fully tapering ribs extending therefrom, and alternatively may be viewed as a cross-sectional end elevation view of a barrel for a spool or reel.

Referring to FIG. 13, one embodiment of a spool 20 in accordance with the invention may include ribs 60 extending completely across the expanse of the flange 24 or barrel 22. In such an embodiment, a cavity 61 terminating in the journal 70 or wall 70 about the arbor hole 28 may be straight-sided. Nevertheless, otherwise, the individual faces 62 of the cavities 61 may be substantially straight, in accordance with draft angles suitable for straightforward extraction. Each of the cavities 61 may be particularly elongated. Nevertheless, due to the tapered nature thereof, any core portion of a mold that must mate with corresponding portions of the other mold half, does not have such a close tolerance or clearance that interleaving is a substantial problem. Nevertheless, sizes of specific walls 60, 64 forming the ribs 60 and cross-ribs 64, must be matched to the particular thermal properties, chilling accommodations, and the like, for the mold. Nevertheless, in one embodiment, a barrel 22 may be made in accordance with the illustration of FIG. 13. Nevertheless, as illustrated, the spool 20 is shown as an end view of a flange 24 in FIG. 13. An advantage of the design of FIG. 13 is the shape and proximity of each of the cross-ribs 64. In a flange, considerable flexibility may remain in the flange 24. Thus, a design in accordance with the embodiment of FIGS. 10–12 may provide more stiffness orthogonally to the direction of the principle ribs 60. However, if the illustration of FIG. 13 is used as a pattern for the ribs 50 (in place of the ribs 60) of a barrel 22 (in place of a flange 24), then stiffness for connecting between the ribs 60, 50 may be adequate as illustrated. Moreover, the portion of the outer envelope of the cross-section of FIG. 13 provides substantially improved tangential angles and support for stranded materials wound thereon.

Moreover, viewing FIG. 13 as an end view from the outside of a spool 20 looking at the ribs 60 on a flange 24, the flange wall 48, itself, provides substantial stiffening between the individual ribs 60. Nevertheless, a bending moment, applied near the crown rim 68, may typically be resisted by substantially less stiffness than would a moment or axial load applied 90 degrees away, about the arbor hole 28.

Comparing the embodiments of FIGS. 12 and 13 illustrates comparative advantages of each. Substantial stiffness may be achieved in the embodiment of FIG. 12, without losing the self-centering effect of papered cores. Moreover, the embodiment of FIG. 13 requires a substantially longer interleaving of cores.

Figure 14:
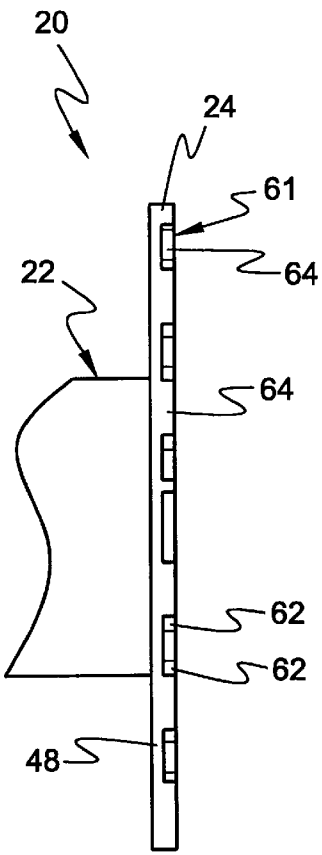
FIG. 14 is a side elevation view of a flange in accordance with the illustration of FIG. 13.

Referring to FIG. 14, and generally to FIGS. 14–19, a flange 24 of a spool 20 may be molded with a barrel 22 of any design described herein or related thereto. In the embodiment of FIG. 14, a view of the cavities 61 shows the tapering faces 62 of the ribs 60, terminating at the intervening or shared cross-ribs 64 extending therebetween. In general, the comparative thicknesses of all dimensions may be adapted to a particular application, size, resin, and so forth. Likewise, the comparative dimensions of each cavity 61 may be adjusted with those of the ribs 60 and cross-ribs 64, in conjunction with the flange wall 48, stiffened thereby.

Figure 15:
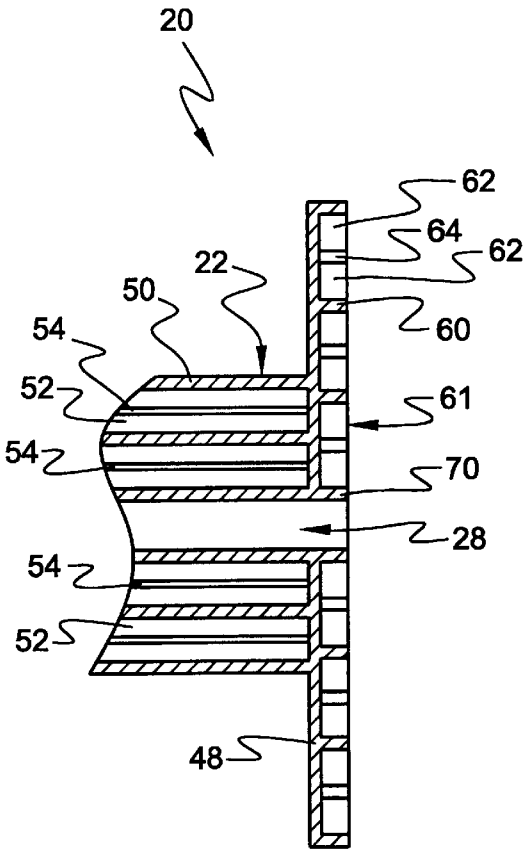
FIG. 15 is a side, elevation, cross-sectional view of a reel fabricated after the embodiment of FIG. 12.

Referring to FIG. 15, in one embodiment, a spool 20 in accordance with the invention may be formed to provide a barrel 22 having the tapered faces 52 terminating at a cross-rib 54. In the illustration of FIG. 15, one recognizes that a cross-rib 54 may advantageously be placed near the center or parting line between the mold halves, forming the barrel 22. That is, it may not be appropriate to form a barrel 22 having many openings (cavities 51) on one half of the barrel 22, and only cross-ribs 64 on the other. As a matter of fact, such a construction is impossible, if not made in accordance with FIG. 13, in most circumstances. Nevertheless, a continuing taper from an outer surface of the envelope of the barrel 22 toward the parting line may be made in accordance with FIG. 12, to form a cross-section illustrated in FIG. 15.

The flange 24 illustrated in FIG. 15 also shows a positioning of hybrid cavities 78, for each of the cavities 61. Thus, the individual faces 62 of the ribs 60 taper toward the interior face 66 of a cross-rib 64 extending between the adjacent ribs 60. Thus, in one embodiment, the illustration of FIG. 15 may be viewed as a cross-section of one embodiment of a spool 20 made in accordance with the design of FIG. 12 for both the barrel 22 and the flange 24. As discussed previously, a design of a barrel 22 may be completely different from the design of a flange 24 associated therewith. Nevertheless, the embodiment of FIG. 15 illustrates one design in which a mold may be fabricated in two pieces having self-centering cores or fingers that interleave with one another readily, rather than presenting close clearances that might be subject to damage from this alignment.

Figure 16:
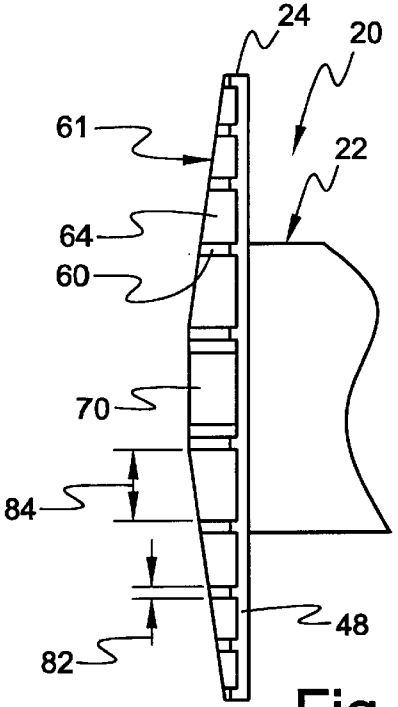
FIG. 16 is a side elevation view of one embodiment of the reel of FIG. 10 or FIG. 11.
Figure 17:
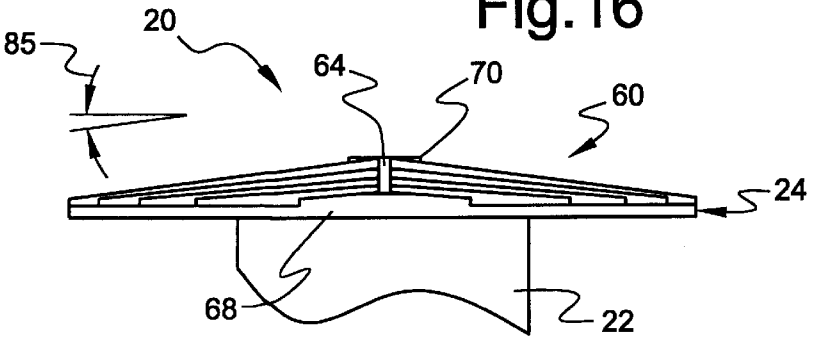
FIG. 17 is a side elevation view, taken orthogonally with respect to an axial direction and the side elevation view of FIG. 16, for the reel of FIG. 16.

Referring to FIGS. 16–17, side views of one embodiment of a spool 20 in accordance with the invention, are consistent with the design of FIG. 10. Nevertheless, the embodiment of FIG. 16 may also be implemented in accordance with FIG. 11. The tapered arrangement of the flanges 24 of FIGS. 16–17 may also be used generally in any of the designs of 9–15.

Referring to FIG. 16, a barrel 22 may be formed by any suitable means, and preferably by molding in a single molding operation. In one embodiment, the barrel 22 and the flange 24 may include similar cross-sectional arrangement of ribs. That is, for example, any of the configurations of FIGS. 9–15 may be used, as appropriate, as a pattern for the barrel 22, the flange 24, both, either, or neither.

Generally, the thickness 82 of each rib 60 may be identical or the thickness 82 may vary. In one embodiment, the spacing 84 between adjacent ribs 60 may be uniform or non-uniform. In the embodiment illustrated in FIG. 16, a non-uniform spacing 84 between adjacent ribs 60 maintains more uniformity of aspect ratio between the depth of cavities 61 and the spacing 84 between ribs 60 defining those cavities 61.

As a practical matter, the cross-ribs 64 may be offset from one another, as illustrated in FIG. 11. Nevertheless, to the extent that FIG. 17 may be viewed as a side elevation view of the spool 20 of FIG. 16 (or one embodiment thereof), the cross-ribs 64 may be collinear as illustrated in FIG. 10. The taper in the flange 24 may accommodate the increased moment in the spool 20 nearer the barber aperture 28 and its surrounding journal 70.

No details of the barrel 22 are shown. The barrel 22 may take on any suitable cross-sectional arrangement selected for the strength and performance required.

Referring to FIG. 17, the taper angle 85 may be constant at all radial orientations. In general, the radial arrangement of ribs is avoided in most embodiments of an apparatus and method in accordance with the present invention. Radial ribs typically require axial motion of a mold forming the ribs 60. Therefore, in presently preferred embodiments of an apparatus 20 in accordance with the invention, the flanges 24 are formed by a single-axis linear motion of a mold. The taper angle 85 provides additional draft. In one embodiment, the taper angle 85 may be reduced to provide only a minimum draft angle (typically one half to one degree). Nevertheless, the taper angle 85 on the ribs 60 may be substantially greater than a basic draft angle.

The journal 70 need not extend above the maximum height of the ribs 60. The journal 70 need not exist at all. The wall 48 may have sufficient dimension to support or provide a bearing surface for an arbor through the arbor hole 28. Nevertheless, to the extent that manufacturing is improved or performance, such as stiffness, strength, wear, etc. is served, the journal 70 may take on any suitable dimension in an axial direction with respect to the spool 20. The cross-ribs 64 need not be aligned as illustrated in FIG. 17.

To reduce clutter, the illustration of FIG. 17 reflects an orientation of the center-most arrangement of a cross-rib 64. In certain presently preferred embodiments, the offset of the cross-rib 64 in accordance with the illustrations of FIGS. 11–15 may be adapted, and are considered included in, the details of the spool 20 of FIG. 17.

Referring to FIG. 18, a spool 20 may include a flange 24 that is closed. For example, sufficient stiffness and strength may be designed into the thickness 86 of barrel ribs 51. The spacing 84 of cavities 51 in a barrel 22 may be suitably arranged to provide a suitable tangency of stranded material (e.g. wire) about the circumference of the barrel 22.

Meanwhile, the wall thickness 88 of the flange 24, and particularly the wall 48 forming the inside face of the flange 24, may have sufficient material and strength to serve adequately. Thus, the individual ribs 60 across the wall 48 may provide sufficient strength and stiffness with suitable selection of some spacing 84 defining the cavities 61. Nevertheless, an additional wall 89 may fit within the overall thickness 90 of the flange 24. Draft angles must provide release of mold elements forming the cavities 61. Thus, the cross-ribs 64 may be arranged in any suitable manner. Alternatively, the cross-ribs 64 may be distanced with. However, whether completely hollow or whether terminated by cross-ribs 64, the cavities 61 may extend between adjacent walls 48, 89.

Referring to FIG. 19, one embodiment of a spool 20 in accordance with the invention may include extremely small wall thicknesses 86 defining a virtual honeycomb of cavities 51, 61. The walls 48, 89 define a flange 24. One difficulty in molding a spool 20, in accordance with the embodiment of FIG. 19, is the presence of numerous, long, narrow fingers forming the honeycomb lattice of ribs 50, 60 and apertures 51, 61 therebetween. The illustration of FIG. 19 represents, primarily, one extreme of structure providing comparatively small gaps 51, 61 between ribs 50, 60.

FIG. 1 illustrates another extreme. Nevertheless, a suitable wall thickness 82 for ribs 60, and a wall thickness 86 of the barrel ribs 50 may be selected independently to be identical. The gaps 51, 61 or cavities 51, 61 may be of a size selected to minimize material, maximize strength provide suitable toughness, strength, smoothness, draft, cycle time, and so forth.

Figure 20:
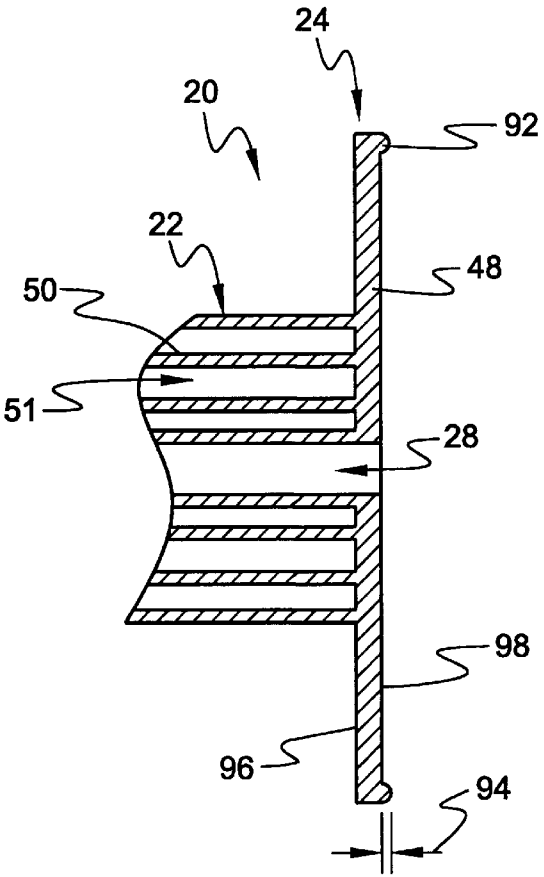
FIG. 20 is a side, elevation, cross-sectional view of another alternative embodiment of the reel of FIG. 9.

Referring to FIG. 20, a core pull from the flange 24 can provide a rim 92. The offset 94 between the wall 48 and the extremity of the rim 92 is an inclusion requiring axial motion of a mold core. As illustrated in FIGS. 1–8, core slides may be used for the formation of the cavities 51 and ribs 50 of the barrel 22. Alternatively, a mold may use a core pull by means of a plate forming the outer face 98 opposite the inner face 96 of the wall 48 of the flange 24. However, a plate having a comparative area required to form the outer face 98 and rim 92 requires substantial force. Accordingly, the design of an embodiment consistent with the illustration of FIG. 20 may require core slides for the barrel 22 in a mold opening axially to form the end face 98 of the flange 24.

FIG. 20 illustrates an embodiment consistent with the embodiment of FIG. 9. The cavities 51, however, may be arranged in any suitable format with the flange 24 having a rim 92. Thus, as mentioned above, any barrel 22 may be associated with any flange 24.

Figure 21:
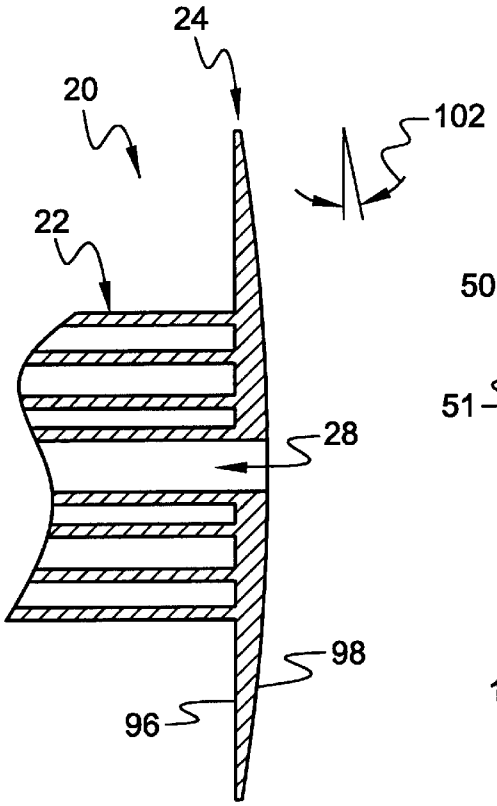
FIG. 21 is a side, elevation, cross-sectional view of an alternative embodiment for a flange of the reel of FIG. 9.

Referring to FIG. 21, a spool 20 having a flange 24 tapered radially or transversely, with respect to either an axial center line, or a plane therethrough, may provide stiffness without a rim 92. Certain benefits of a rim 92 include structural strength and stiffness for supporting a spool 20 or reel 20 on a surface. A rim 92 provides a more robust contact region. Nevertheless, the spool 20 may be formed in a single piece from a single molding operation, without core pulls.

The arbor hole 28 is always an exception, since the arbor hole dimension may be sufficiently small that the core rendering the hole 28 is regarded as a mere pin in the mold. The overall load required to support a pin forming the arbor hole 28 is substantially smaller than that required to form a face 98 of FIG. 20. Thus, the embodiment of FIG. 21 may be formed in a single molding operation without post-molding assembly, and without requiring multi-dimensional motion of mold pieces, except for the pin through the arbor hole 28. As discussed previously, a pin forming the arbor hole 28 may extend from a non-pressurized area within a mold through the pressurized cavity of the mold, and out to another non-pressurized region of the mold.

The offset 94 or depth 94 of the rim 92 (see FIG. 20) with respect to the outer face 98 of the flange 24 adds substantially to the effectiveness of the small amount of material provided in the rim 92. That is, the rim 92 may uniformly surround the flange 24. Nevertheless, the embodiment of FIG. 21 maintains a taper angle 102 resulting in a maximum thickness nearer the arbor hole 28 and a minimum thickness near the outermost extreme of the radial edge of the flange 24. Thus, the maximum material thickness 88 extends over a smaller area of the flange 24.

In one embodiment, the angle 102 need not be constant. For example, the face 96 of FIG. 21 is typically flat in one presently preferred embodiment. The face 98 may be either tapered at a constant angle 102, or arcuate with a continuously variable angle 102. Each arrangement has unique benefits. Mold release and draft angles may argue for a constant angle 102.

Figure 22:
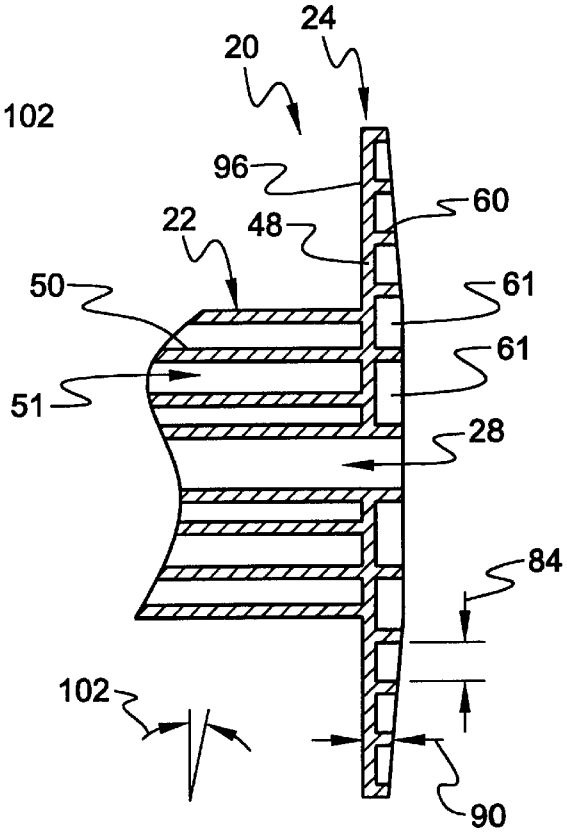
FIG. 22 is an end, elevation, cross-sectional view of an alternative embodiment of the flange of FIG. 9, FIG. 10, and FIG. 11.

Referring to FIG. 22, a spool 20 having a taper angle 102 between the faces 96, 98 provided no substantial advantage in supporting an increased moment within the envelope of the barrel 22. That is, tapering from the outermost radius of the flange 24 to the arbor hole 28, is not necessary. Accordingly, a taper may run from the outermost diameter or radius of the flange 24 to a position corresponding to the outermost radius of the barrel 22. The spacing 84 of the ribs 60 may be regular, irregular, uniform, or non-uniform, etc. Likewise, the overall thickness 90 of the flange, may be tapered or cambered in an arcuate angle 22. The gaps 51, may similarly be arranged uniformly or non-uniformly in order to optimize use of material, strength, and tangency of stranded materials wound thereon.

Figure 23:
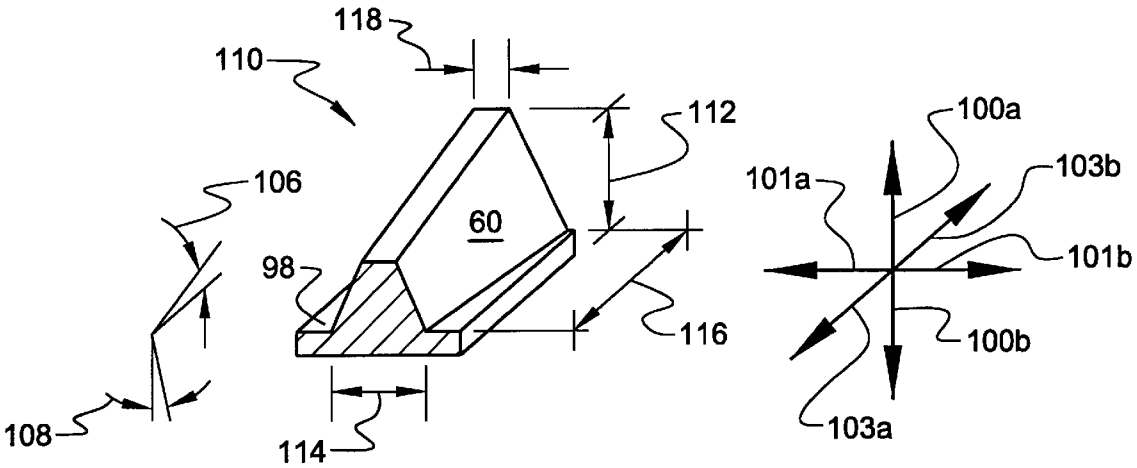
FIGS. 23–28 illustrate perspective views of segments of alternative embodiments for the cross-sections of ribs and cross-ribs in the reels of FIGS. 1–22.

Referring to FIGS. 23–28, cross-sectional views of alternative embodiments for individual ribs 50, 60 demonstrate options for maximizing strength and stiffness while minimizing material. Referring to FIG. 23 and generally to FIGS. 23–29, while continuing to refer generally to FIGS. 1–29, directions 100, 101, 103 may define transverse 100, lateral 101, and longitudinal 103, directions with respect to a rib 50, 60 for one purpose of discussion, one may regard a rib 60 as extending axially 100*a* away from a face 98 of a flange 24. Accordingly, the transverse direction 100 may correspond to an axial direction 100 of a spool 20.

Similarly, the longitudinal direction 103 and lateral direction 101 are both radial directions of the flange 24, in such a circumstance. Regarding, for other purposes of discussion, a rib 50 of a barrel 22, the longitudinal direction 103 may be regarded as an axial direction of a barrel 22, with the lateral direction 101 and transverse direction 100 orthogonal thereto in a radial direction with respect to the barrel 22. Nevertheless, in one presently preferred embodiment, the various, optional, cross-sectional shapes of FIGS. 23–28, may best apply to ribs 60 disposed along the outer faces 98 of flanges 24.

Referring to FIG. 23, a trapezoidal shape may begin at an outer surface 98 of a flange 24, or at some point there above. Accordingly, a rise angle 102 defines a change in a height 112 of the rib 60 above the face 98. The trapezoidal cross-section 110 of FIG. 23 may also change along a length 116 thereof, according to a spread angle 108. That is, if the base 114 or base width 114 of the cross-section 110 of FIG. 23 is allowed to vary along the length 116, while the top width 118 is maintained constant, then the spread angle 108 of the trapezoid is constant. However, the base width 114 must increase, along with the height 112 with respect to the length 116. The comparative angles 106, 108 may be designed to simply be the minimum draft angle required for good manufacturing practice. Alternatively, and depending upon the particular dimensions of a spool 20, or a reel 20, the angles 106, 108 and the dimensions 112, 114, 116, 118 may be selected to minimize material of a maximized strength, maximized toughness, and so forth.

Figure 25:
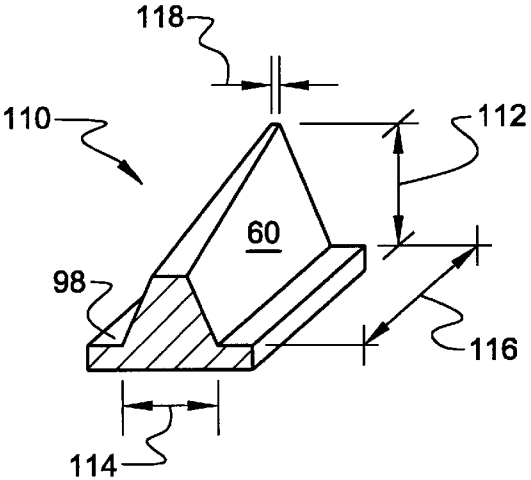
Figure 24:
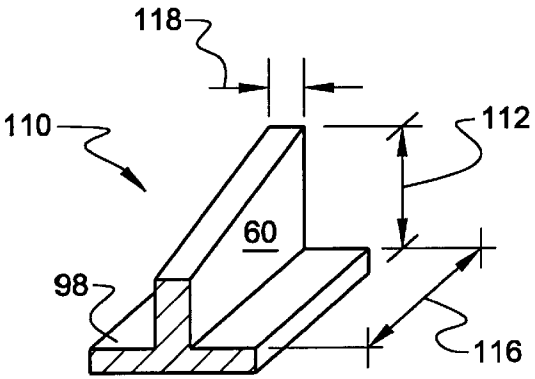

Referring to FIG. 24, a cross-section 110 of a rib 60 may rise from the face 98 of a flange 24 to a height 112 varying along a length 116 of the rib 60. In the embodiment of FIG. 24, the width 118 defines both the top width 118 and the bottom width 114. Referring to FIG. 25, the top width 118 may become comparatively small, and may vary in a longitudinal direction 103 along a length 116 of the cross-section 110.

For example, in one embodiment, the base width 114 may be constant. Alternatively, the base width 114 may vary but not so severely as that of FIG. 23. Thus, the top width 118 of the cross-section 110 may vary along the length 116 in a longitudinal direction 103 in order to maintain the spread angle 108. Nevertheless, one may view FIG. 25 as illustrating a fully variable base width 114, top width 118, rise angle 106, spread angle 108, and so forth, in order to accommodate good molding practice for accommodating the length 116 and height 112 required of a rib 60 on a flange 24.

Figure 26:
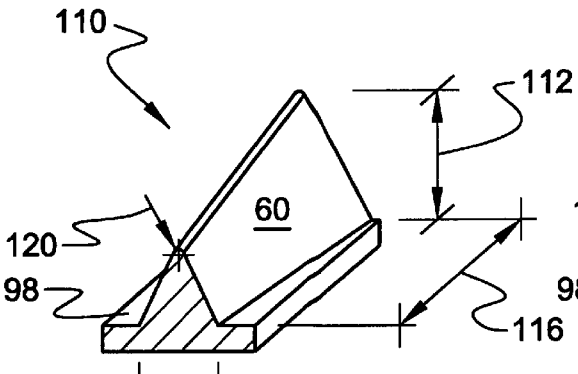

Referring to FIG. 26, a cross-section 110 may include a constant radius 120 along a top of a rib 60. The base width 114 may be constant or variable, as illustrated in FIG. 26. In the embodiment of FIG. 26, the increase of the base dimension 114 in an axial direction 103 along the length 116 of the rib cross-section 110 sustains a constant spread angle 108 defining a triangular cross-section 110. For the sake of illustration, FIGS. 23–29 are not to scale. Each of the angles 106, 108 and the comparative dimensions 112, 114, 116, 118 may vary so subtlety as to the imperceptible to a casual observation.

Figure 27:
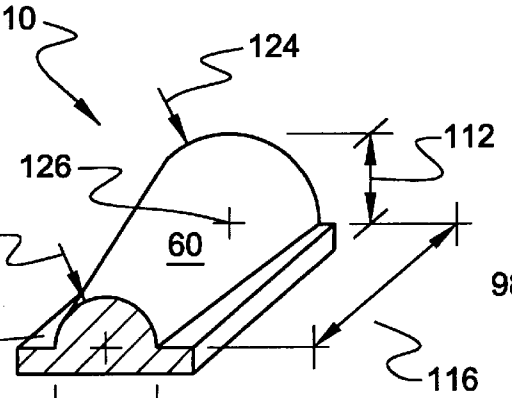

Referring to FIG. 27, one cross-section 110 adaptable to a rib 60 may include a semi-circular cross-section 110 having a base dimension 114 and defined by an outer radius 122. Radii 122, 124 may vary along a center 126 or center line 126 extending in a longitudinal direction 103 along the length 116 thereof. The height 112 may accommodate draft or may be substantially greater in order to minimize material usage in locations away from the arbor hole 28, those locations not being exposed to such a great moment arm from the flange 24. The radius 122 may be constant, or may vary along the length 116. Likewise, the radius 122 may be established on top of a particular rib 60.

Figure 28:
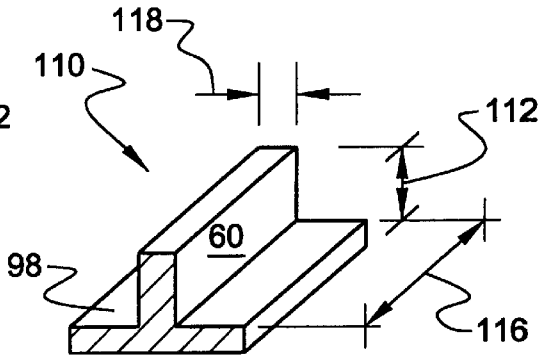

Referring to FIG. 28, a rib 60 may have a cross-section 110 that remains constant, accommodating only a slight draft angle for good manufacturing practice. Accordingly, a face 98 may extend between adjacent rib 60 at a substantially uniform dimension. The height 112 may be substantially constant. The length 116 may be selected in accordance with the embodiments of FIGS. 9–22. The base width 114 may be the same as the top width 118, for all practical purposes.

Figure 29:
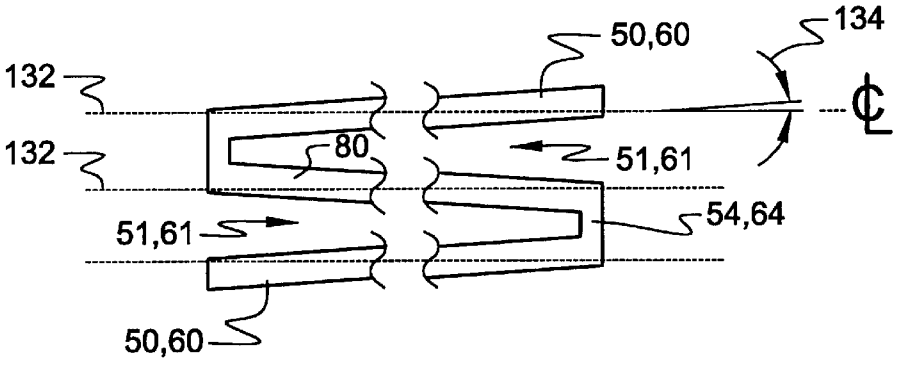
FIG. 29 is a plan view of a rib of a flange in accordance with the invention, and may also represent schematically a cross-sectional view of a portion of a barrel of selected embodiments of reels made in accordance with the invention.

Referring to FIG. 29, ribs 50, 60 defining cavities 51, 61 extend between cross-ribs 54, 64. The illustration of the embodiment of FIG. 29 is some what schematic in nature. The principal feature regards the center lines 132. The center lines 132 represent a longitudinal direction 103 in which a mold may travel in forming the ribs 50, 60. Nevertheless, each of the cavities 51, 61 is separated from adjacent cavities 51, 61 by an intervening wall 80 that forms the actual rib 50, 60 the wall 80 may be oriented along a center line 132 as illustrated in FIG. 9. Accordingly, depending on the particular length 116 of a rib 50, 60 draft angles may be accommodated within a displacement 134 or displacement angle 134, with respect to the center lines 132.

Thus, the nominal center lines 132 of ribs 50, 60 do not form the actual center lines of the ribs 50, 60. Thus, a smaller, constant, wall thickness 118 (e.g. wall thickness 86, 88) may exist due to matching the overall length 116 of a rib 51, 61, the comparative location of the cross-ribs 54, 64 (e.g. see FIGS. 11, 12, 13, etc.).

Particularly in the barrel 22, where lengths 116 or heights 112 of ribs 51 may be comparatively shorter, sufficient angular displacement 134 may be available within the width 86 of a rib 51 to provide equal draft on opposite sides with a constant wall thickness. Nevertheless, the embodiment of FIG. 29 is not required. The embodiment of FIG. 29 does illustrate however the utility of offsetting cross-ribs 54, 64 to maximize stiffness and minimize material use, while providing self-centering and rapid release of molded parts.

A combination of flange 24 and barrel 22 arrangements (e.g. see FIGS. 9–13), coupled with an appropriate arrangement of cross-section (e.g. see FIGS. 23–28), along with suitable tapering of ribs 50 or ribs 60 or both 50, 60 (e.g. see FIGS. 14–17), may be combined with suitable selections of wall thickness and draft angles (e.g. see FIG. 29) in order to provide maximum strength, maximum stiffness, maximum toughness, maximum smoothness, maximum molding rate, optimized mold repeatability, with minimum wall thickness, minimum resin use, and minimum cost for the performance available.

Moreover, in an apparatus and method in accordance with the invention, spools 20 and reels 20 manufactured in a mold need not require any post-molding assembly operations. Production rates, man-power costs, quality control checks, and the like may all be reduced accordingly.

The present invention maybe embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A one-piece injection molded utility reel comprising:

an elongate barrel having a longitudinal axis of rotation;

a plurality of walls lying in spaced apart relation parallel to said axis;

hub portions, each said hub portion lying substantially in a plane normal to said axis of rotation and disposed at an end of said barrel; and cross-walls extending substantially transversely between adjacent walls.

2. The reel of claim 1, further comprising flanges extending radially from said hub portions.

3. The reel of claim 2, wherein at least one of said flanges has a through hole located proximal and outside the surface of said barrel and having an axis substantially parallel to said longitudinal axis.

4. The reel of claim 2, wherein at least one of said flanges has a through hole located proximal the periphery of at least one of said flanges and having an axis substantially parallel to said longitudinal axis.

5. The reel of claim 1, wherein said barrel and hub portions have a common through hole extending along said longitudinal axis for accommodating an arbor.

6. The reel of claim 5, wherein said hub portion has a drive hole offset from said through hole and extending parallel to said axis.

7. A reel comprising:

a barrel adapted to receive a stranded material therearound, the barrel having an axial direction, radial directions, a single lateral direction, and a transverse direction substantially orthogonal to the lateral direction, the single lateral direction extending radially from and orthogonal to the axial direction, the lateral direction being orthogonal to at least one of the radial directions, and the barrel also having first and second ends;

a first flange proximate the first end of the barrel;

a second flange proximate the second end of the barrel;

the barrel further comprising ribs spaced apart in the transverse direction to extend substantially axially and laterally; and cross-ribs extending substantially transversely between adjacent ribs.

8. The reel of claim 7, wherein the cross-ribs are disposed along an outer circumference of the barrel.

9. The reel of claim 7, wherein the cross-ribs are disposed substantially along a plane extending axially and transversely.

10. The reel of claim 7, wherein a first cross-rib is offset in a lateral direction from a second cross-rib transversely adjacent to the first cross-rib.

11. The reel of claim 7, further comprising flange ribs molded to the respective first and second flanges, and spaced transversely and extending substantially laterally, for increasing the section modulus of the first and second flanges.

12. The reel of claim 7, wherein the reel is molded of a polymeric resin.

13. The reel of claim 12, wherein the polymeric resin has a toughness property, the ribs have a rib thickness, the flange ribs have a flange rib thickness, each selected to operate in combination to be effective to render the reel functional to contain and dispense the stranded material following a standard drop test.

14. The reel of claim 13, wherein the standard drop test is selected from a standard bench test comprising dropping the reel, fully loaded with a wire product, from a height corresponding to a workbench.

15. The reel of claim 13, wherein the standard drop test comprises a standard storage test comprising dropping the reel, fully loaded with a wire product, from a height corresponding to a storage location.

16. A reel comprising:

a barrel having first and second ends spaced apart in an axial direction, and having a lateral direction and a transverse direction substantially orthogonal to the axial direction and one another;

a first flange proximate the first end;

a second flange proximate the second end;

the barrel further comprising ribs spaced apart in the transverse direction to extend substantially axially and laterally; and cross-ribs extending substantially transversely between adjacent ribs.

* * * * *

UNITED STATES PATENT AND TRADEMARK OFFICE

CERTIFICATE OF CORRECTION

PATENT NO. : 5,967,455
DATED : October 19, 1999
INVENTOR(S) : Terry L. Farber

It is certified that error appears in the above-identified patent and that said Letters Patent is hereby corrected as shown below:

On the title page, Item [56]

In References Cited, please change "4,184,640" to --4,184,650--.

Signed and Sealed this

Fifth Day of December, 2000

*Attest:*

Q. TODD DICKINSON

*Attesting Officer*

*Director of Patents and Trademarks*